US011668110B2

(12) United States Patent
Zheng

(10) Patent No.: US 11,668,110 B2
(45) Date of Patent: Jun. 6, 2023

(54) HOUSE CONSTRUCTION STRUCTURE

(71) Applicant: XINJIANG TIANDI GROUP, Xinjiang (CN)

(72) Inventor: Daqing Zheng, Xinjiang (CN)

(73) Assignee: XINJIANG TIANDI GROUP, Xinjiang (CN)

( * ) Notice: Subject to any disclaimer, the term of this patent is extended or adjusted under 35 U.S.C. 154(b) by 0 days.

(21) Appl. No.: 16/762,769

(22) PCT Filed: May 18, 2018

(86) PCT No.: PCT/CN2018/087503
§ 371 (c)(1),
(2) Date: May 8, 2020

(87) PCT Pub. No.: WO2019/091081
PCT Pub. Date: May 16, 2019

(65) Prior Publication Data

US 2020/0362578 A1 Nov. 19, 2020

(30) Foreign Application Priority Data

Nov. 13, 2017 (CN) ..... 201711114370.8

(51) Int. Cl.
*E04H 1/04* (2006.01)
*E04H 1/00* (2006.01)
(Continued)

(52) U.S. Cl.
CPC ..... *E04H 1/04* (2013.01); *E04H 1/005* (2013.01); *E04B 1/003* (2013.01); *E04B 2001/0053* (2013.01); *E04H 1/06* (2013.01)

(58) Field of Classification Search
CPC .. E04H 1/005; E04H 1/04; E04H 6/44; E04B 1/003
(Continued)

(56) References Cited

U.S. PATENT DOCUMENTS 3,874,137 A * 4/1975 Gentry ..... E04H 1/00 52/169.1
5,199,231 A * 4/1993 Dever ..... E04B 1/003 52/176
(Continued)

FOREIGN PATENT DOCUMENTS

CN 2931672 Y 8/2007
CN 101545321 A 9/2009
(Continued)

OTHER PUBLICATIONS

Bosco Verticale by Boeri Studio https://www.archdaily.com/777498/bosco-verticale-stefano-boeri-architetti?ad_medium=gallery.*
(Continued)

*Primary Examiner* — Paola Agudelo
(74) *Attorney, Agent, or Firm* — Venable LLP; Henry J. Daley

(57) ABSTRACT

The present disclosure provides a house construction structure including: an odd-numbered floor, an even-numbered floor and outdoor private gardens. Living rooms of each odd-floor house and each even-floor house which are vertically corresponding to each other, are vertically corresponding to each other; each living room is provided with one outdoor private garden. The outdoor private gardens of all living rooms of odd-floor houses which are vertically corresponding to each other, are vertically corresponding to each other and are located in an identical first direction; the outdoor private gardens of all living rooms of even-houses which are vertically corresponding to the odd-floor houses, are vertically corresponding to each other and are located in an identical second direction. Each living room of each house is located at an outer wall corner of each house; each living room of each house includes at least one outer wall corner and at least two adjacent outer walls in different directions, so that private gardens of each odd-floor house
(Continued)

and each even-floor house which are vertically corresponding to each other, are disposed on the two adjacent outer walls of the respective living rooms of each odd-floor house and each even-floor house which are vertically corresponding to each other, and located in two different directions.

14 Claims, 28 Drawing Sheets

(51) Int. Cl.
*E04B 1/00* (2006.01)
*E04H 1/06* (2006.01)

(58) Field of Classification Search
USPC ..... 52/236.3, 236.4
See application file for complete search history.

(56) References Cited

U.S. PATENT DOCUMENTS 5,528,866 A * 6/1996 Yulkowski ..... E04H 1/04 52/79.12
5,694,725 A * 12/1997 Kaufman ..... E04H 1/04 52/234
6,209,270 B1 * 4/2001 Johnston ..... E04H 14/00 52/33
8,402,698 B1 * 3/2013 Wang ..... E04H 6/10 52/29
2003/0005653 A1 * 1/2003 Sataka ..... E04H 1/04 52/236.3
2004/0237421 A1 * 12/2004 Franz ..... E04H 6/28 52/79.1
2005/0138867 A1 * 6/2005 Zhao ..... E04H 1/04 52/79.1
2009/0113821 A1 * 5/2009 Guo ..... E04H 1/04 52/173.1
2009/0151280 A1 * 6/2009 Jones ..... E04H 1/04 52/236.3
2010/0287850 A1 * 11/2010 Jadhav ..... E04H 1/04 52/169.1
2010/0306137 A1 * 12/2010 Newman ..... G06Q 99/00 705/500
2011/0132250 A1 * 6/2011 Nelson ..... E04H 1/04 114/266
2011/0209402 A1 * 9/2011 Hu ..... A01G 9/12 47/29.5
2011/0296769 A1 * 12/2011 Collins ..... E04B 1/945 52/79.1
2016/0348384 A1 * 12/2016 Zheng ..... E04H 1/06
2018/0194442 A1 * 7/2018 Loudrup ..... E04B 1/7675
2018/0230692 A1 * 8/2018 Thebaud ..... E04H 1/005
2019/0119935 A1 * 4/2019 Zheng ..... E04H 3/00

FOREIGN PATENT DOCUMENTS

CN 204645712 U 9/2015
CN 105672697 A 6/2016
CN 205777664 U 12/2016
CN 106801535 A 6/2017
CN 107905557 A 4/2018
JP 2001-012097 A 1/2001
KR 101010250 B1 1/2011
KR 10-2013-0028236 A 3/2013
KR 10-2016-0138342 A 12/2016
SU 603737 A1 4/1978
WO 2006/0001497 A1 1/2006
WO 2006/116904 A1 11/2006
WO 2009/014754 A2 1/2009

OTHER PUBLICATIONS

Written Opinion issued in corresponding Singapore Application No. 11202004445R dated Feb. 14, 2014.
Korean Office Action issued in corresponding KR 10-2020-7016834 dated Sep. 30, 2021.
Office Action issued in Chinese Application No. 2017111143703 dated Aug. 15, 2022 (with English Translation).

* cited by examiner

HOUSE CONSTRUCTION STRUCTURE

CROSS-REFERENCE TO RELATED APPLICATION

This application is a National Stage Application under 35 U.S.C. § 371 PCT/CN2018/087503, filed May 18, 2018, which claims the benefit and priority of Chinese Application No. 201711114370.8, filed on Nov. 13, 2017, the disclosures of which are incorporated in their entirety by reference herein.

TECHNICAL FIELD

The present disclosure relates to the field of building design and building production and installation, and in particular to a house construction structure.

BACKGROUND

At present, all buildings in the city are high-rise residential buildings, multistory residential houses and glass-walled office buildings which are built with reinforced concrete. At a glance, all buildings are the same, which makes the whole city seem dull, dry and lifeless. Living in urban buildings is like living in a reinforced concrete cage, and is completely disconnected from the outside sun, air and nature. Even if one house has a garden balcony, the garden balcony appears narrow and depressed because its height is limited to the same height as the floor, thus sight lines become narrower and the light cannot enter the house adequately. Even some house building has a private yard outside which is planted with flowers and trees, and plants on outer walls, but its two-storey private yard will block windows of an upper-floor house. Thus, the upper-floor house cannot be directly light and then become a black house. Meanwhile, residents of the house on an upper floor can directly see all scenes of the private yard of the house on the lower floor, and the private yard of the house on the lower floor loses privacy and security. This is the biggest defect of such houses.

These characteristics of current urban buildings restrict people's needs for basic quality of life such as living space, greenery, nature, sunlight, air purification, environmental beauty, safety and privacy. While suburban villas waste a lot of land, their geographical positions are far away from the city, which brings great inconvenience to people's life, such as clothing, food, housing, transportation and medical care. Therefore, how to make the living environment in the city have both a beautiful environment like the countryside and the convenience of centralized supply of urban resources has become a new breakthrough point for persons to study urban building design, which is the fourth revolution in the field of architecture.

SUMMARY

In view of the above technical problems, the present disclosure provides a house construction structure, which solves the problem of adding green space to a high-rise building, allows the high-rise building to have outdoor private gardens similar to a villa, and also allows direct lighting of all rooms, thereby avoiding formation of black houses and allowing all private gardens and houses have security and privacy.

Although the house construction structure of the present disclosure has better living quality than villas, its land occupation and construction cost are only equal to those of ordinary high-rise buildings. It causes a qualitative change in the input-output ratio of the building and enables people to live completely farewell birdcage-style living era, and it is a model of urban vertical greening, three-dimensional greening and "sponge city". It will completely change people's living environment and home environment; meanwhile, it makes it easier and faster to park and drive home.

According to an aspect of the present disclosure, a house construction structure is provided and includes: an odd-numbered floor, an even-numbered floor and outdoor private gardens. Each of the odd-numbered floor and the even-numbered floor includes one unit house, two unit houses or multi-unit houses; each unit house includes one house, two houses or multiple houses. Living rooms of each odd-floor house and each even-floor house which are vertically corresponding to each other, are vertically corresponding to each other; each living room is provided with one outdoor private garden. The outdoor private gardens of all living rooms of odd-floor houses which are vertically corresponding to each other, are vertically corresponding to each other and are located in an identical first direction; the outdoor private gardens of all living rooms of even-houses which are vertically corresponding to the odd-floor houses, are vertically corresponding to each other and are located in an identical second direction. Such arrangement allows all private gardens to have a height of two floors and large space. Since the outdoor private gardens of all living rooms of odd-floor houses are located in a direction different from a direction in which the outdoor private gardens of all living rooms of even-floor houses are located, the private garden on an upper floor will not affect the lighting of the living room and other rooms on a lower floor, thereby allowing direct lighting of the living room on the lower floor.

Meanwhile, in the plane layout, each living room of each house is located at an outer wall corner of each house, so that each living room of each house includes at least one outer wall corner and at least two adjacent outer walls in different directions. In this way, private gardens of each odd-floor house and each even-floor house which are vertically corresponding to each other, are disposed on the two adjacent outer walls of the respective living rooms of each odd-floor house and each even-floor house which are vertically corresponding to each other, and located in two different directions, thereby ensuring privacy of outdoor private gardens of each odd-floor house and each even-floor house, and allowing each outdoor private garden to have at least two lighting surfaces in two directions and a large space.

Further, for each wall having a window of each room of each of odd-floor houses and the even-floor houses, no private garden is provided on a vertically corresponding wall of a room on an upper floor and a vertically corresponding wall on a lower floor. Such arrangement allows direct lighting of each room having a widow, thereby avoiding formation of black houses. Meanwhile, such arrangement enables windows of all rooms on the upper floor do not directly face the private garden on the lower floor, thereby allowing the private gardens to have security and privacy.

Optionally, one unit house may be a whole building; or, one unit house may be combined with another one unit house, two unit house or multiple unit houses to form a whole building; or, one unit house, two unit houses or multiple unit houses may be located on one side, two sides or a periphery of an above-ground parking platform, and may be combined with the above-ground parking platform to form a whole building. On each floor of the parking platform, a one-story house, a two-story house or a multi-story house is formed, thereby forming a house construction structure with hanging parking platform. It should be noted that the specific structures of the house and the above-ground parking platform are not limited in the embodiments of the present disclosure.

Optionally, the house construction structure has diversity as a whole, and may be combined into sky quadrangle dwellings, sky single villa, sky townhouse, sky one-story house, sky parking building, or even an sky city including all the above buildings and community functions. It should be noted that the sky quadrangle dwellings, the sky single villa, the sky townhouse, the sky one-story house and the sky parking building may employ existing structures and will not be described herein.

Optionally, the above-ground parking platform is composed of a car elevator, a fire evacuation stair, a passenger elevator, a driving road and parking spaces; the number of floors of the parking platform is in a range of 2 to 30. It should be noted that the car elevator, the fire evacuation stair and the passenger elevator may employ existing structures and will not be described herein.

Optionally, the parking platform and the house construction structure may be integrated.

Optionally, when the house construction structure and the above-ground parking platform are combined with each other, the parking platform is disposed at the north side of the house construction structure, so that the house construction structure is oriented in a direction facing south, southeast and southwest to facilitate the lighting of the house. It should be noted that orientation of the house construction structure and the parking platform is not limited in the embodiment of the disclosure.

Optionally, the above-ground parking platform includes driving roads and pedestrian passages, so that pedestrians and vehicles are separated to ensure the safety of pedestrians. It should be noted that the above-ground parking platform may employ existing structures and will not be described herein.

Optionally, an edge of the above-ground parking platform is provided with reinforced concrete railings poured along with the parking platform. It should be noted that material of the railings is not limited in the embodiment of the disclosure.

Optionally, the house construction structure of the present disclosure does not require large excavation to construct an underground parking, and only needs to excavate an occupied part of the building itself as the foundation and air defense layer. The occupied part between one building and another building does not need to be excavated. This not only saves construction costs and management costs such as lighting and exhaust in the underground parking, but also allows people to not park in dark underground parking. Instead, people can drive the car directly to their door through the car elevator. Meanwhile, the occupied part between one building and another building, which is not to be excavated, can seep rainwater to reduce urban waterlogging, thereby increasing groundwater resources and reducing the pressure on the drainage network, which is also the focus of the construction of "sponge city".

Optionally, the number of floors of the odd-numbered floor and the even-numbered floor is cyclically arranged according to a required height of the house construction structure; the outdoor private gardens are set according to the number of houses on each floor. The area of the private garden is designed according to the size of the room, and may be large or small. For example, the number of odd-numbered floors and the even-numbered floors is 30-60, which is not limited thereto.

Optionally, a green area of an outdoor private garden is between 10 square meters and 200 square meters, generally 40 square meters to 70 square meters is suitable. Of course, it can be understood that the area of the outdoor private garden is not specifically limited in the embodiments of the present disclosure.

Optionally, the outdoor private garden may be used for planting trees, planting flowers, planting vegetables, dog walking, bird breeding, leisure, entertainment, parties, dinners, etc. Of course, it can also be understood that the function of the outdoor private garden is not specifically limited in the embodiments of the present disclosure.

Optionally, the outdoor private gardens of all living rooms of odd-floor houses are located in a direction different from a direction in which the outdoor private gardens of all living rooms of even-floor houses are located, i.e., the outdoor private gardens of all living rooms of odd-floor houses which are vertically corresponding to each other, are vertically corresponding to each other and are located in an identical direction; the outdoor private gardens of all living rooms of even-houses which are vertically corresponding to the odd-floor houses, are vertically corresponding to each other and are located in an identical another direction. Such arrangement allows all private gardens to have a height of two normal floors, for example, 3 meters to 30 meters. A width of the private garden may be 2 meters to 20 meters, and a depth of the private garden may be 2 meters to 10 meters. The preferred height is the height of two normal floors.

Optionally, in the plane layout, each living room of each house is located at an outer wall corner of each house, so that each living room of each house includes at least one outer wall corner and at least two adjacent outer walls in different directions. In this way, private gardens of each odd-floor house and each even-floor house which are vertically corresponding to each other, are disposed on the two adjacent outer walls of the respective living rooms of each odd-floor house and each even-floor house which are vertically corresponding to each other, and located in two different directions, thereby allowing each outdoor private garden to have at least two lighting surfaces in two directions and a large space.

Optionally, for the two adjacent outer walls in different directions of each living room of each house, a width of the living room corresponding to each outer wall is 2 meters to 10 meters. Of course, it can be understood that the width of the living room is not limited in the embodiment of the present disclosure Optionally, in order to enter and exit the outdoor private garden of one odd-floor house and the outdoor private garden of one even-floor house which is vertically corresponding to the one odd-floor house, a door-and-window is formed in the outer wall of a living room of the one odd-floor house, and a door-and-window is formed in the outer wall of a living room of the one even-floor house; and the outer wall of the living room of the one odd-floor house and the outer wall of the living room of the one even-floor house are in different directions.

Optionally, a door-and-window is formed in one outer wall of each the living room, and the private garden of each the living room is formed on the one outer wall. It should be noted that the door-and-window may employ the existing door-and-window and will not be described herein.

Optionally, no window is provided in the outer wall of an upper layer vertically corresponding to each of the outdoor private garden and the odd-floor outdoor private garden of the living rooms at a current odd-numbered floor or a current even-numbered floor, so that the outdoor private garden at a current floor has privacy.

Optionally, according to needs, one house on an upper floor may be provided with a window oriented towards the outdoor private garden of one vertically corresponding house on a lower floor; or, the window and the outdoor private garden may be arranged in different out walls, or the window is set to be a high window; or, an outer windowsill plate or a grille plate is arranged below the window to prevent peeping down, thereby blocking downward view and improving privacy of the private garden of lower-floor room.

Optionally, the house on each of the odd-numbered floor and the even-numbered floor is a duplex house with independent roof, a duplex house without independent roof or a flat-story house. That is, a ground floor of the house on an upper floor may be, or may not be the roof of the house on a lower floor.

Optionally, each of outdoor private gardens for the odd-numbered floor and the even-numbered floor is supported by an oblique supporting column and has a sunken slab with an upturned beam and a sunken portion for filling soil, thereby planting vegetables or flowers and trees in the sunken portion. It should be noted that the structure of the outdoor private garden is not specifically limited in the embodiments of the present disclosure.

Optionally, the house construction structure further includes an automatic drip irrigation system or an automatic sprinkler irrigation system in the outdoor private garden. It should be noted that the structure of the automatic drip irrigation system or the automatic sprinkler irrigation system is not specifically limited in the embodiments of the present disclosure.

Optionally, the sunken slab of the outdoor private garden is provided with a waterproof layer and a drain. It should be noted that the structure of the waterproof layer and the drain is not specifically limited in the embodiments of the present disclosure.

Optionally, in an upper layer of the waterproof layer, a waterproof layer-protective layer of fine stone concrete is also be made, to prevent tree roots from passing through and destroying the waterproof layer. It should be noted that the structure of the waterproof layer and the drain is not specifically limited in the embodiments of the present disclosure. Further, the drain is provided near the wall with the lowest slope.

Optionally, the flowers and trees include big trees, low plants, shrubs and flowers. The height of the big tree is 3 meters to 5 meters. Under each big tree, a tree pool with a height of 0.2 meters to 1 meter may be set up to increase the thickness of the soil layer of the big tree. The height of low plants, shrubs and flowers is 0.1 meters to 3 meters. It should be noted that the specific types and heights of flowers and trees are not specifically limited in the embodiments of the present disclosure.

Optionally, outdoor railings may be provided at an outer edge of the outdoor private garden to prevent falling accidents. It should be noted that the specific shape and height of the outdoor railings are not specifically limited in the embodiments of the present disclosure.

Optionally, the houses and outdoor private gardens may employ any existing construction forms such as concrete structure, steel structure or steel-concrete structure, and may also be installed with prefabricated components. It should be noted that the specific structure of the houses and outdoor private gardens are not specifically limited in the embodiments of the present disclosure.

Optionally, the purpose of the above building structure is any one of residence, apartment, guesthouse, hotel, restaurant, office premises and office building. It should be noted that the purpose of the above building structure is not specifically limited in the embodiments of the present disclosure.

The above technical solutions have the following advantages or beneficial effects: ingenious new design is adopted on the outer wall and floor layout of the building, which fully utilizes outer wall space of the building to make the new building body look like a mountain with flowers and trees except for windows of main rooms. A group of buildings is like a forest, so that the entire urban building no longer looks like reinforced concrete, dry and lifeless.

Meanwhile, in the plane layout, the technical solution creatively sets the living room at an outer wall corner of each house, so that each living room of each house includes at least one outer wall corner and at least two adjacent outer walls in different directions. In this way, private gardens of each odd-floor house and each even-floor house which are vertically corresponding to each other, are disposed on the two adjacent outer walls of the respective living rooms of each odd-floor house and each even-floor house which are vertically corresponding to each other, and located in two different directions, thereby allowing each outdoor private garden to have at least two lighting surfaces in two directions and a large space and allowing each outdoor private garden to have two-sided view or three-sided view.

Further, such arrangement allows direct lighting of each room. Meanwhile, such arrangement allows all private gardens to have a height of two floors of the building, comfort of space height, sense of space, lighting and view is unmatched by the low space of the garden balcony in traditional building. Although some buildings have two-storey garden balconies, upper and lower floors are full of windows, and residents of adjacent garden balconies can also see each other, and thus all residents have no privacy and security at all.

Compared with traditional buildings, the house construction structure of the present disclosure does not increase any building occupation area, and may be built anywhere in the city center, unlike traditional villas that are mostly built in far suburbs, which will bring great difficulties to people's life, work, study, medical treatment.

The house construction structure of the present disclosure makes up for three major defects that cannot be overcome by all similar buildings at home and abroad: the defect (1), residents in gardens which are vertically or horizontally adjacent to each other, can see each other and thus there is poor privacy issue; defect (2), gardens which are vertically or horizontally adjacent to each other can be overturned and thus there is safety hazard; defects (3), all main rooms cannot be directly lighted and thus become black house and other disadvantages. In all outdoor private gardens of this present disclosure, neighbors which are vertically or horizontally adjacent to each other, cannot see each other, and outdoor private gardens cannot be overturned, so that the odd-floor houses and the even-floor houses have absolute privacy and security, as well as main rooms of the odd-floor houses and the even-floor houses can be directly lighted, thereby avoiding formation of "black house".

The house construction structure of the present disclosure is a greener and more environmentally friendly building that is more innovative and more humanized than all traditional buildings. It completely breaks shackles of people's living with the outer wall as the boundary, and builds hanging outdoor private gardens, so that each family has an oversized hanging outdoor private garden with a height of two floors and having two-sided view or three-sided view.

It should be noted that the attached drawings do not list other available plan views and elevation views, and the drawings do not limit the number of actual apartment types in a building of a house structure, and the number, sizes or areas of the apartment layouts in the building may be modified and changed as needed.

Description of reference signs:

1 house

2 door-and-window for even-floor living room opened toward private garden

3 even-floor outdoor private garden;

4 living room of house;

5 door-and-window for odd-floor living room opened toward private garden;

6 odd-floor outdoor private garden;

7 passenger elevator;

8 evacuation stair;

9 elevator-and-evacuation stair platform;

10 car elevator;

11 driving road;

12 parking space;

13 outdoor private garden sinking board;

14 oblique supporting column;

15 flowers and trees;

16 outer wall of upper layer vertically corresponding to outdoor private garden;

17 indoor stair;

18 upper floor in duplex house;

19 room window.

DETAILED DESCRIPTION

Exemplary embodiments of the present disclosure will be described hereinafter in details with reference to the accompanying drawings. Although exemplary embodiments of the present disclosure are shown in the accompanying drawings, it should be understood that the present disclosure may be implemented in various forms and should not be limited by the embodiments described herein. On the contrary, these embodiments are provided in order to enable a more thorough understanding of the present disclosure and to fully convey the scope of the present disclosure to those skilled in the art.

Figure 1:
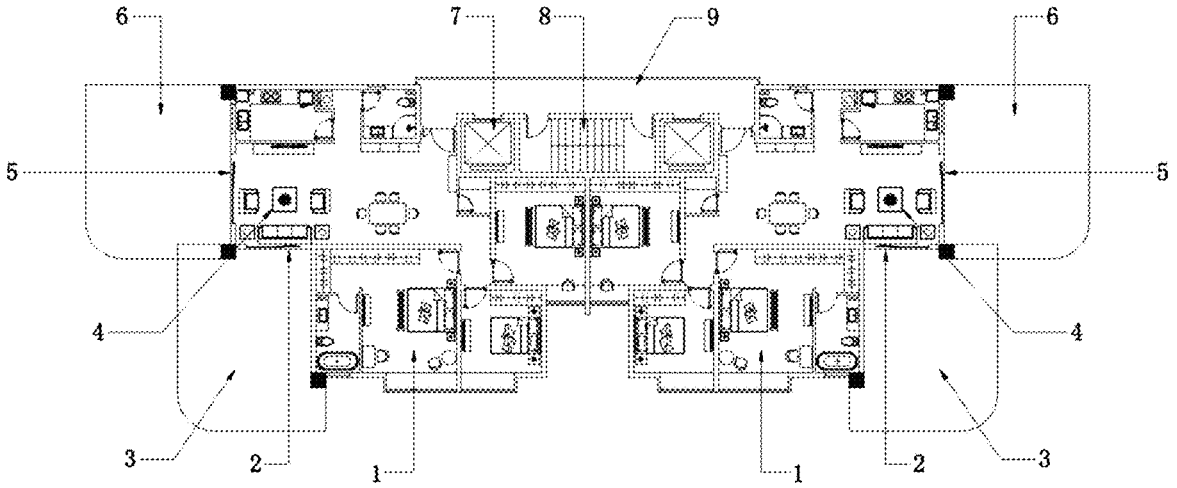
FIG. 1 is a schematic diagram showing overall structural relationship between an odd-floor house, an even-floor house and outdoor private gardens according to an embodiment of the present disclosure.

Referring to FIG. 1 to FIG. 27, and first referring to FIG. 1, FIG. 1 is a schematic diagram showing overall structural relationship between an odd-floor house, an even-floor house and outdoor private gardens according to an embodiment of the present disclosure. It should be noted that the drawing shows a unit with two houses on each floor, one unit with multiple houses on each floor is similar to this and will not be repeated herein.

Referring to FIG. 1, the house construction structure includes: a house 1, an odd-floor living room and an even-floor living room 4 which are vertically corresponding to each other, a door-and-window 2 for the even-floor living room 4 opened toward an even-floor outdoor private garden 3, a door-and-window 5 for the odd-floor living room opened toward an odd-floor outdoor private garden 6. Moreover, optionally, the house construction structure may further include one or more of a passenger elevator 7, an evacuation stair and an elevator-and-evacuation stair platform 9.

Referring to FIG. 1, the odd-floor house 1 and the even-floor house 1 are vertically corresponding to each other; the odd-floor living room and the even-floor living room 4 are also vertically corresponding to each other. Each even-floor living room 4 is provided with an outdoor private garden. The odd-floor outdoor private garden 6 and the even-floor outdoor private garden 3 are disposed outside the respective living rooms at different directions, so that each private garden has a height of two floors and the living room on a lower floor can be directly lighted, as shown in FIG. 20A to FIG. 27.

Referring to FIG. 1, each of the even-floor living room 4 and the odd-floor living room is disposed at an outer wall corner of each house. Each of the even-floor living room 4 and the odd-floor living room includes at least one outer wall corner and at least two adjacent outer walls in different directions, so that private gardens of the odd-floor house and the even-floor house which are vertically corresponding to each other, are disposed on the two adjacent outer walls of their living rooms, respectively, and located in two different directions. In this way, persons in vertically adjacent private gardens or horizontally adjacent private gardens cannot see each other. Since the private garden has a height of two floors, each outdoor private garden has at least two lighting surfaces in two directions and a large space.

Referring to FIG. 20A to FIG. 27, no private garden is provided on each wall having a window of each room of each of odd-floor house and the even-floor house, a vertically corresponding wall having a window of a room on the upper floor and a vertically corresponding wall having a window of a room on the lower floor. In this way, each room having a widow can be directly lighted; meanwhile, windows of the all rooms on the upper floor do not directly face the private garden on the lower floor, so that all main rooms can be directly lighted.

Referring to FIG. 2, FIG. 4, FIG. 6 and FIG. 8, these drawings show plan views of an odd floor of a house structure. It should be noted that the drawing shows a unit with two houses on each floor, one unit with multiple houses on each floor is similar to this and will not be repeated herein.

Referring to FIG. 3, FIG. 5, FIG. 7 and FIG. 9, these drawings show plan views of an even floor of a house structure. It should be noted that the drawing shows a unit with two houses on each floor, one unit with multiple houses on each floor is similar to this and will not be repeated herein.

Combining FIG. 2 to FIG. 9, it can be seen transformation relationship between a direction from the odd-floor living room to its outdoor private garden and a direction from the even-floor living room to its outdoor private garden, and these drawings shows positions of the door-and-window 5 and the door-and-window 2 opened toward respective outdoor private gardens. Of course, it should be noted that specific positions of the door-and-window 5 and the door-and-window 2 are not specifically limited in the embodiments of the present disclosure.

Further, FIG. 2 to FIG. 9 further shows that the upper floor of the door-and-window 5 and the door-and-window 2 for the odd-floor living room or the even-floor living room opened toward respective outdoor private gardens, is a solid wall without windows, as shown in FIG. 20A to FIG. 27. This can ensure that residents on the upper floor cannot view the outdoor private garden of residents on the lower floor through windows, thereby ensuring the privacy of the residents.

Referring to FIG. 4 to FIG. 9, they show a variety of different apartment layouts of house construction structures, such as one unit with two houses on each floor, one unit with three houses on each floor and one unit with four houses on each floor. It should be noted that the number of houses on each floor is not specifically limit in the embodiments of the present disclosure.

Referring to FIG. 10 to FIG. 19, in the embodiments of the present disclosure, a unit house may form a whole building, and may also be combined with another one unit house, two unit houses or multiple unit houses to form a whole building. Meanwhile, one unit house, two unit houses or multiple unit houses may be set on one side, two sides or a periphery of an above-ground multistory parking platform, and may be combined with the above-ground multistory parking platform to form a whole building. On each floor of the parking platform, a one-story house, a two-story house or a multistory house may be formed. The parking platform is composed of a car elevator, a fire evacuation stair, a passenger elevator, a driving road and parking spaces. The number of floors of the parking platform may be set according to needs, generally 2 to 30 floors.

Referring to FIG. 10, FIG. 12, FIG. 14, FIG. 16 and FIG. 18, these drawings show plan views of an odd-numbered floor in a house construction structure combined with a parking platform according to an embodiment of the present disclosure. It should be noted that specific positions of the parking platform on the odd-numbered floor is not specifically limited.

Referring to FIG. 11, FIG. 13, FIG. 15, FIG. 17 and FIG. 19, these drawings show plan views of an even-numbered floor in a house construction structure combined with a parking platform according to an embodiment of the present disclosure. It should be noted that specific positions of the parking platform on the even-numbered floor is not specifically limited.

FIG. 10 to FIG. 19 show a passenger elevator 7, an evacuation stair 8, a car elevator 10, a driving road 11 and parking spaces 12, which together form the parking platform. Meanwhile, as can be seen from the above drawings, there is a unit with one house on each floor, and there is also a unit with two houses on each floor. Further, the house construction may be located at one side, two sides or a periphery of the parking platform, respectively, so that one parking platform is combined with a whole building with multiple units.

Figure 18:
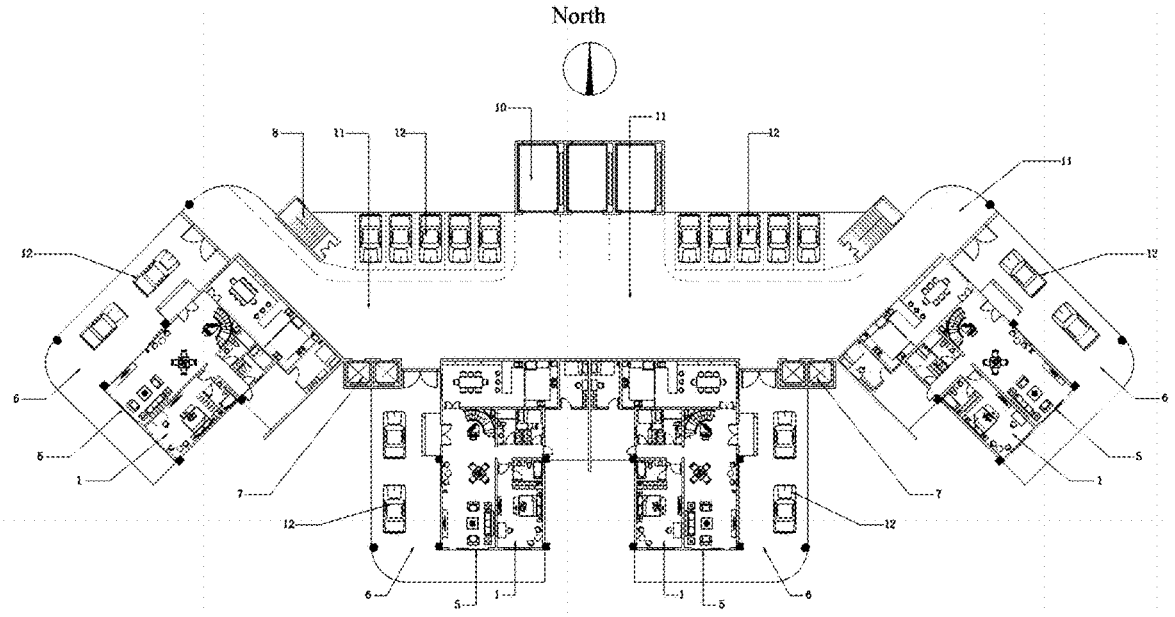
FIG. 18 is a schematic plan view of an odd-numbered floor in a duplex house construction structure combined with a parking platform according to a fifth embodiment of the present disclosure.
Figure 19:
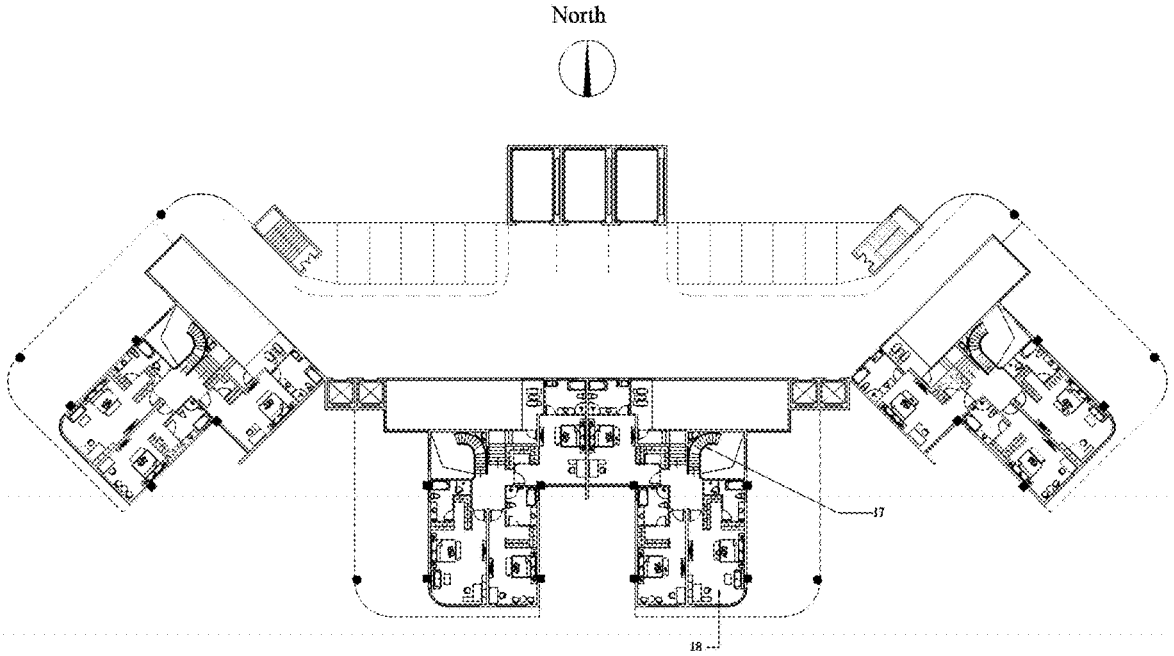
FIG. 19 is a schematic plan view of an even-numbered floor in a duplex house construction structure combined with a parking platform according to a fifth embodiment of the present disclosure.

Referring to FIG. 18 and FIG. 19, FIG. 18 is a schematic plan view of a lower floor in duplex house of a duplex house construction structure combined with a parking platform according to an embodiment of the present disclosure. FIG. 19 is a schematic plan view of an upper floor in duplex house of a duplex house construction structure combined with a parking platform according to an embodiment of the present disclosure.

Referring to FIG. 18 and FIG. 19, as can be seen from the lower floor in duplex house shown in FIG. 18, the reference numeral 1 indicates the house, the reference numeral 5 indicates the door-and-window, the reference numeral 6 indicates the odd-floor outdoor private garden, the reference numeral 7 indicates the passenger elevator, the reference numeral 8 indicates the evacuation stair, the reference numeral 11 indicates the driving road, and the reference numeral 12 indicates the parking space. As can be seen from the upper floor in duplex house shown in FIG. 19, an indoor stair 17 is provided for going up and down the upper floor 18 in duplex house. Meanwhile, the odd-floor outdoor private garden 6 has a height of two floors and space of the parking platform has a height of two floors, and this can ensure the lighting of the parking platform.

Referring to FIG. 20 to FIG. 27, as shown in the drawings, the outdoor private gardens 6 of all odd-floor living rooms 4 which are vertically corresponding to each other, are vertically corresponding to each other and are located in one identical direction. The outdoor private gardens 3 of all even-floor living rooms 4 which are vertically corresponding to the above odd-floor living rooms 4, are vertically corresponding to each other and are located in another direction. Such arrangement allows all private gardens to have a height of two floors and large space, and allows direct lighting of the living room on the lower floor.

Referring to FIG. 1 to FIG. 17, in the plane layout, all odd-floor living rooms and even-floor living rooms 4 are vertically corresponding to each other. Further, in the plane layout, each living room 4 is located at an outer wall corner of one house, so that each living room of the houses includes at least one outer wall corner and at least two adjacent outer walls in different directions. In this way, private gardens of the odd-floor house and the even-floor house which are vertically corresponding to each other, are disposed on the two adjacent outer walls of their living rooms, respectively, and located in two different directions. This can ensure that persons in private gardens corresponding to each even-floor living room and an adjacent odd-floor living room, cannot see each other. Meanwhile, this can allow each outdoor private garden to have at least two lighting surfaces in two directions and a large space.

Referring to FIG. 1 to FIG. 17 as well as FIG. 20A to FIG. 27, for each wall having a window of each room of each of odd-floor house and the even-floor house, no private garden is provided on a vertically corresponding wall of a room on the upper floor and a vertically corresponding wall on the lower floor. In this way, each room having a widow can be directly lighted and will not become a "black house". Meanwhile, each room having a widow has security and privacy and each private garden also has security and privacy.

Referring to FIG. 22 to FIG. 27, no outdoor private garden is provided on outer walls of upper and lower floors vertically corresponding to a window 19. No outdoor private garden is provided on an outer wall 16 of an upper layer of the door-and-window 2 for the even-floor living room opened toward its even-floor outdoor private garden. No outdoor private garden is provided on an outer wall 16 of an upper layer of the door-and-window 5 for the odd-floor living room opened toward its odd-floor outdoor private garden.

Figure 2:
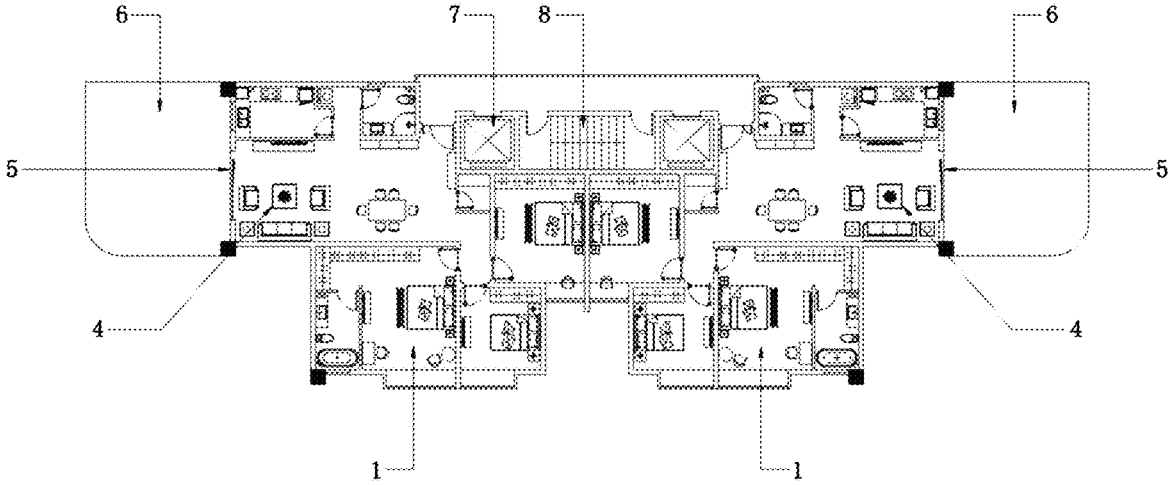
FIG. 2 is a schematic plan view of structure of an odd-floor house structure and an outdoor private garden according to an embodiment of the present disclosure.
Figure 3:
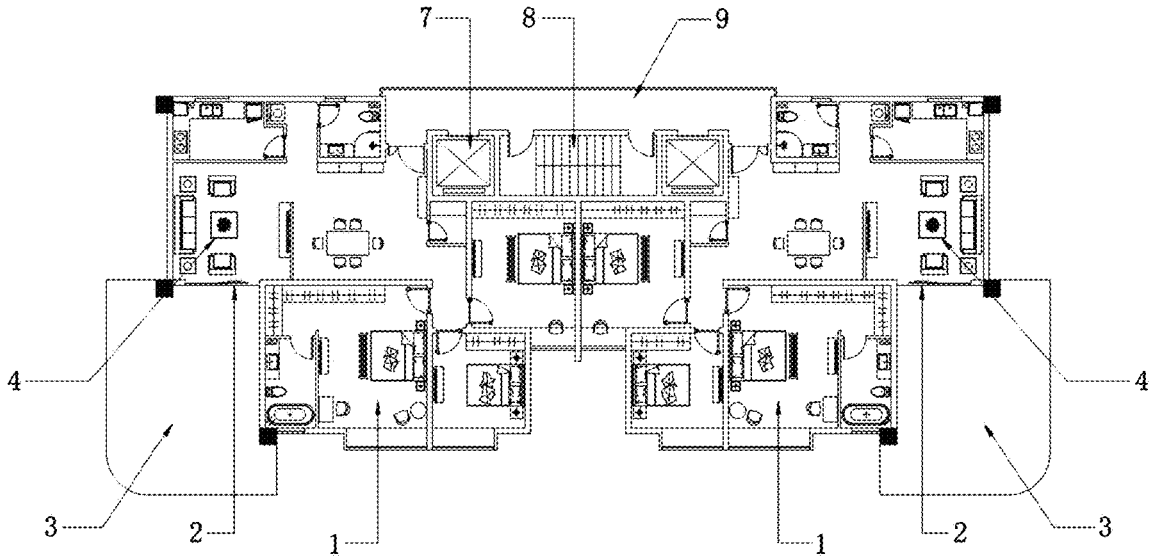
FIG. 3 is a schematic plan view of structure of an even-floor house structure and an outdoor private garden according to an embodiment of the present disclosure.
Figure 4:
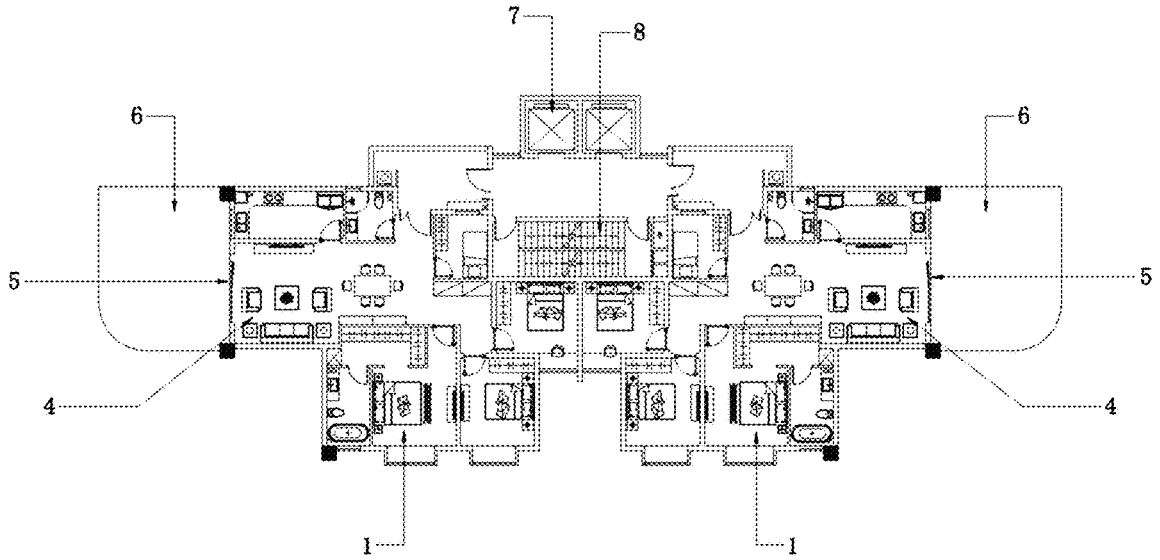
FIG. 4 is a schematic plan view of structure of an odd-floor house structure and an outdoor private garden according to another embodiment of the present disclosure.
Figure 5:
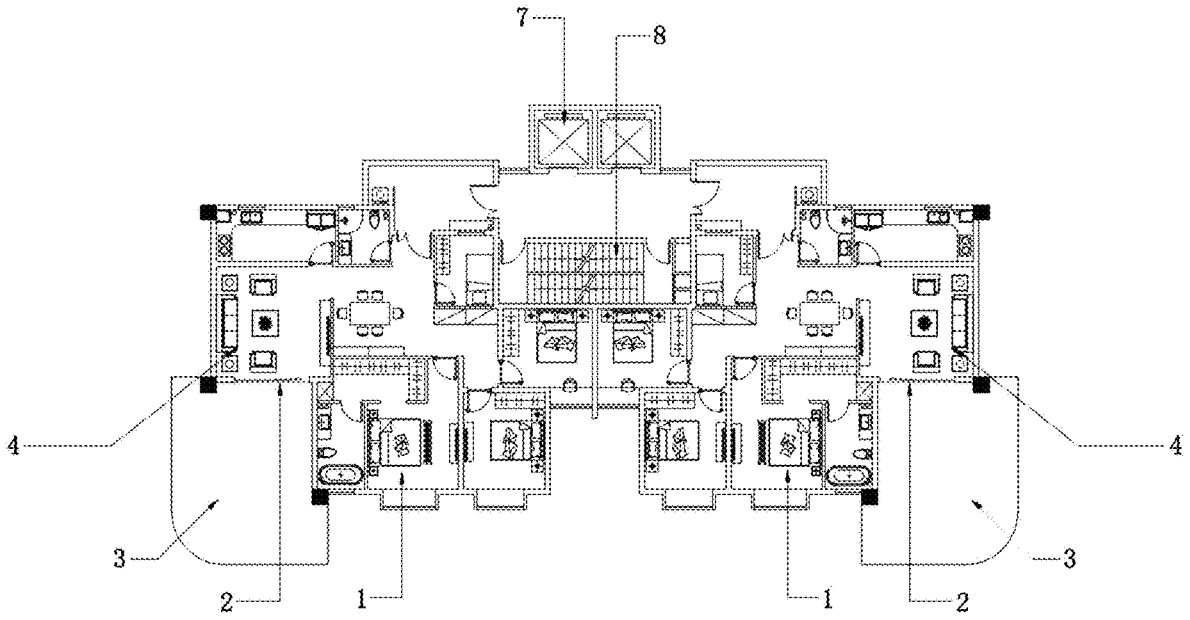
FIG. 5 is a schematic plan view of structure of an even-floor house structure and an outdoor private garden according to another embodiment of the present disclosure.
Figure 6:
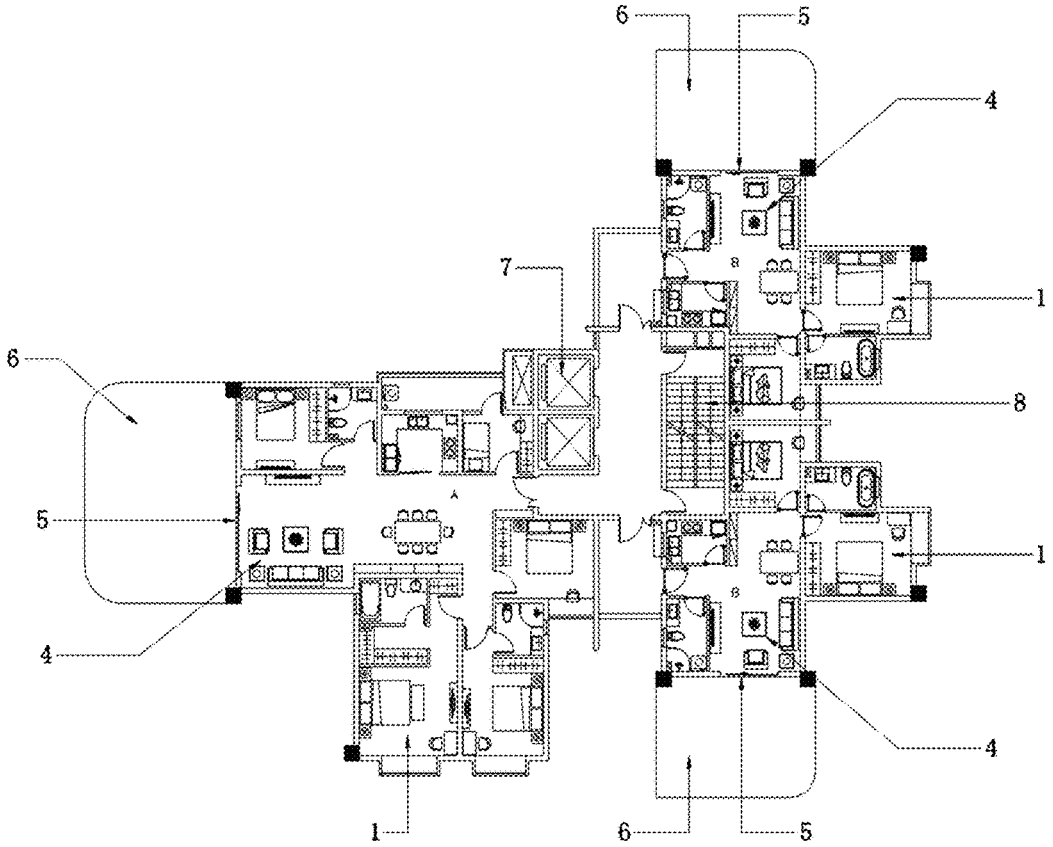
FIG. 6 is a schematic plan view of structure of an odd-floor house structure and an outdoor private garden according to a third embodiment of the present disclosure.
Figure 7:
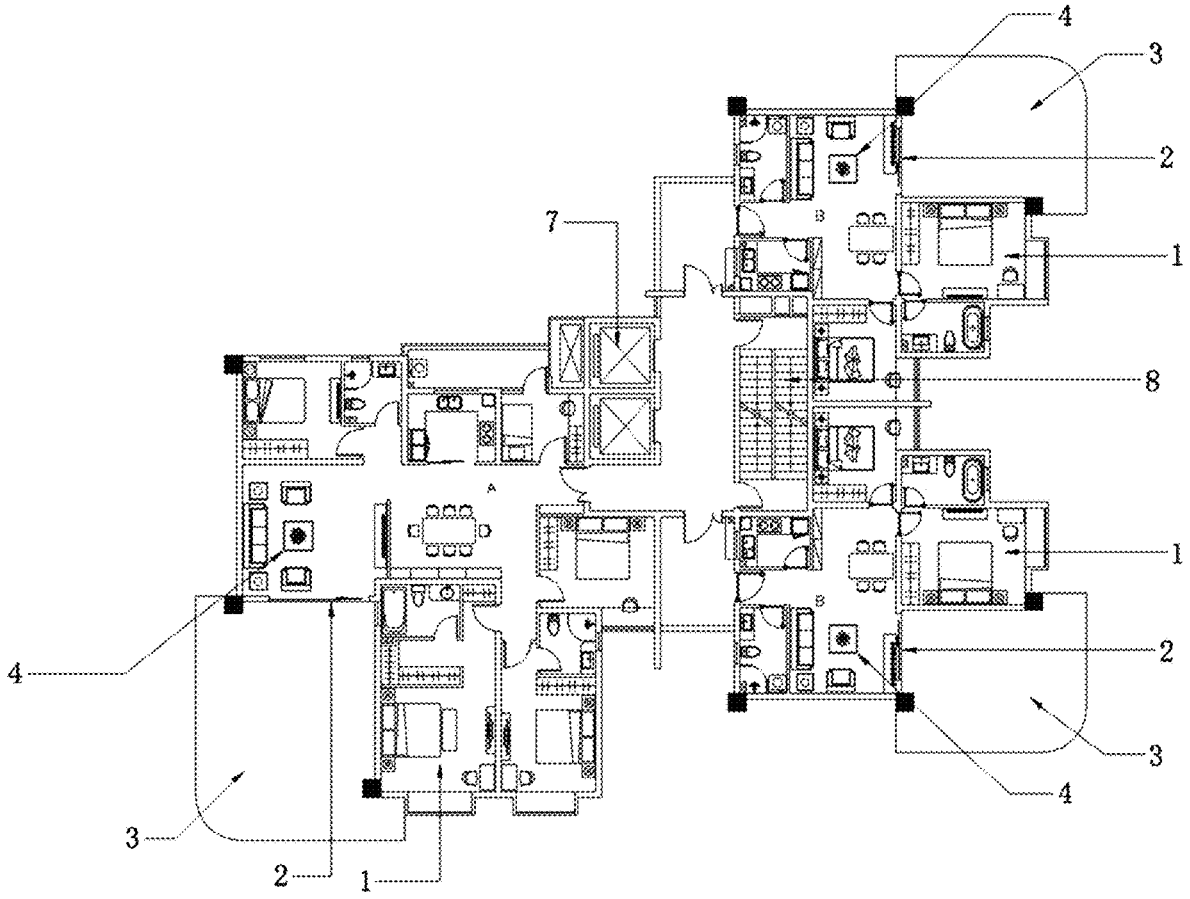
FIG. 7 is a schematic plan view of structure of an even-floor house structure and an outdoor private garden according to a third embodiment of the present disclosure.

Referring to FIG. 1 to FIG. 3, in the plane layout, there are a passenger elevator 7, an evacuation stair 8 and an elevator-and-evacuation stair platform 9. These common characteristics indicate that multiple houses 1 may be combined layer by layer to form a whole building. One or more combinations of the passenger elevator 7, the evacuation stair 8 and the elevator-and-evacuation stair platform 9 constitute necessary travel facilities and safe passages of the whole building.

Referring to FIG. 4 to FIG. 9, as shown in the drawings, the house construction structure has diversity as a whole. For example, one unit house may form a whole building, and may also be combined with another one or more unit houses to form a whole building with one house on each floor, three houses on each floor, four houses on each floor or multiple houses on each floor. It should be noted that although the structure of one house on each floor is not shown, it can be implemented in various forms and should not be limited by the embodiments described herein.

Figure 8:
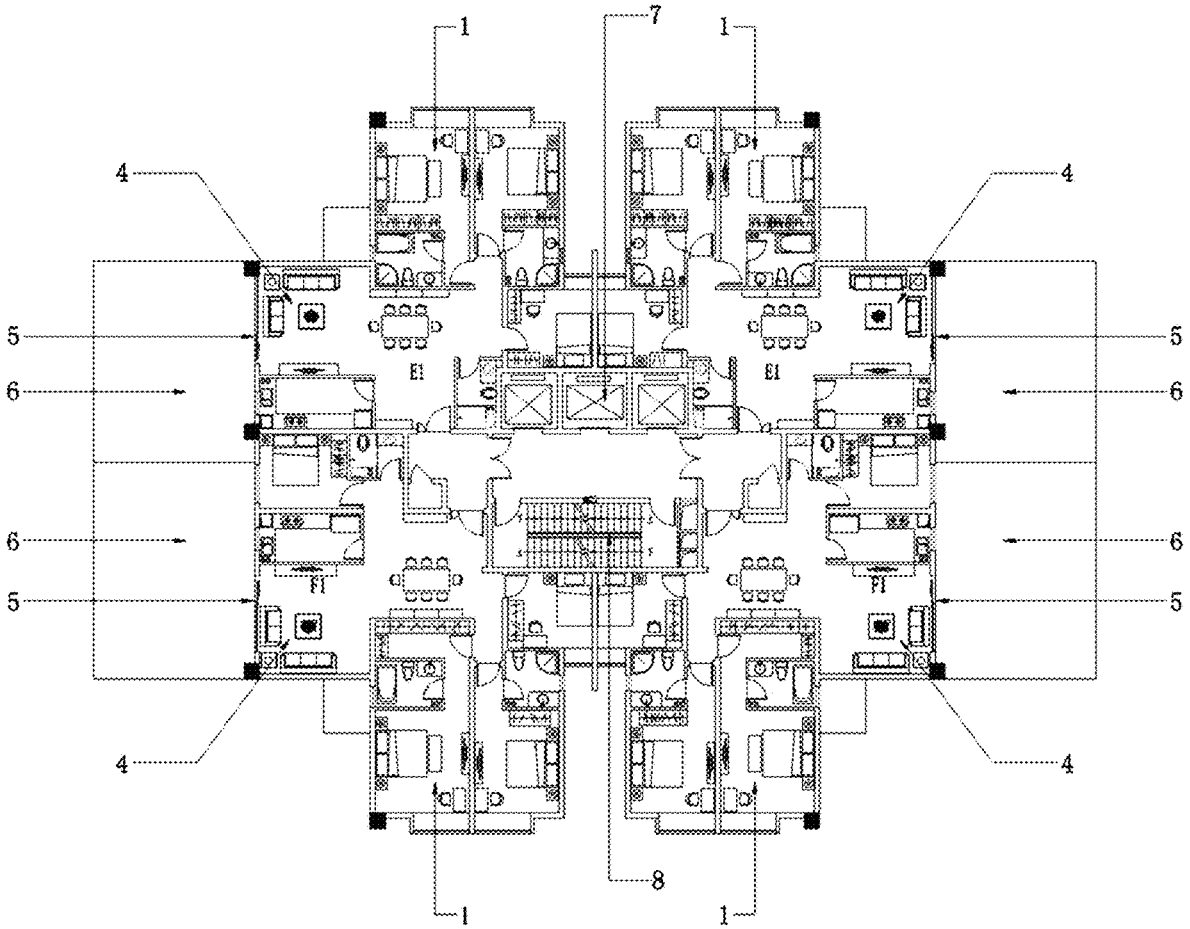
FIG. 8 is a schematic plan view of structure of an odd-floor house structure and an outdoor private garden according to a fourth embodiment of the present disclosure.
Figure 9:
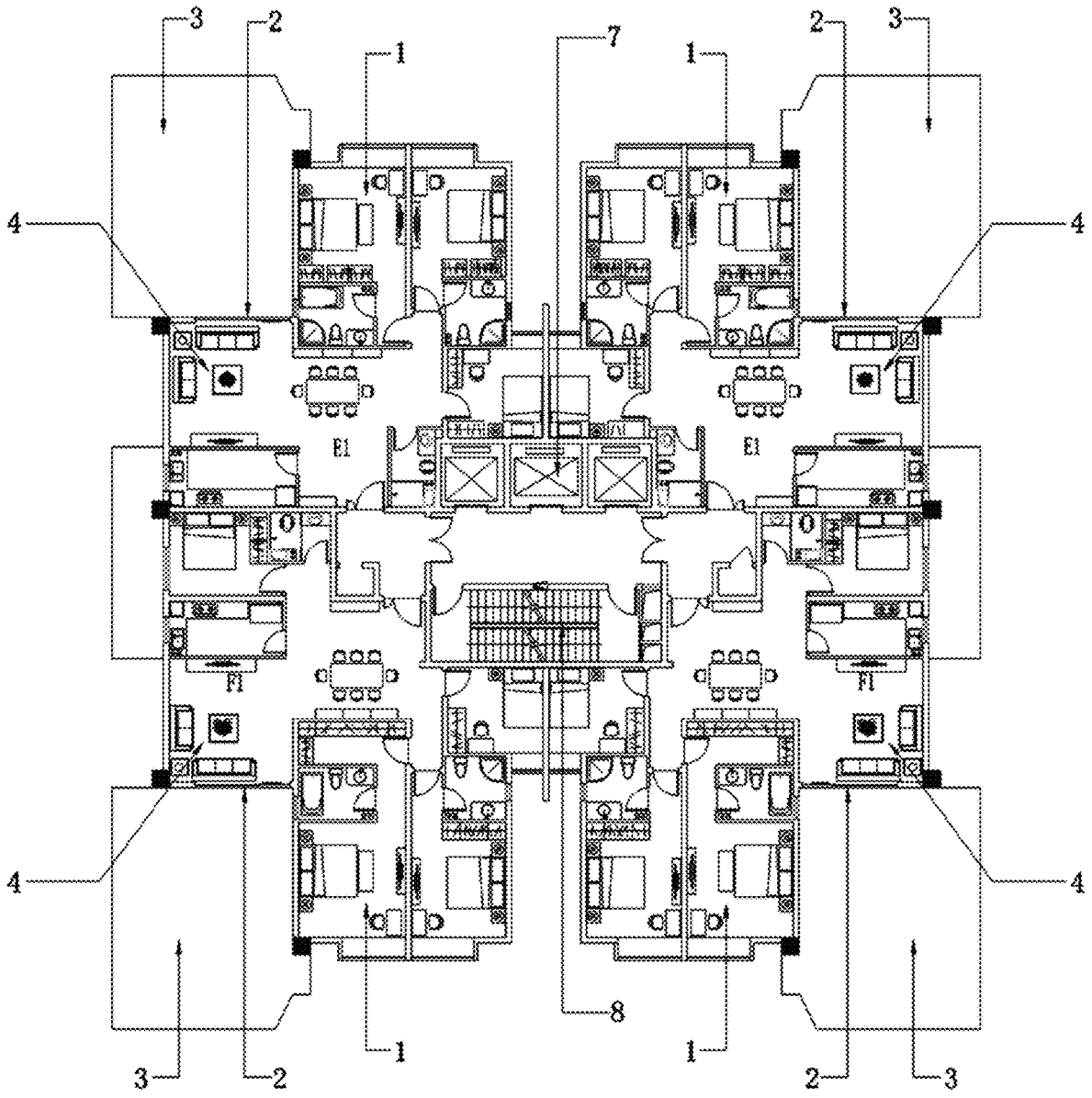
FIG. 9 is a schematic plan view of structure of an even-floor house structure and an outdoor private garden according to a fourth embodiment of the present disclosure.
Figure 10:
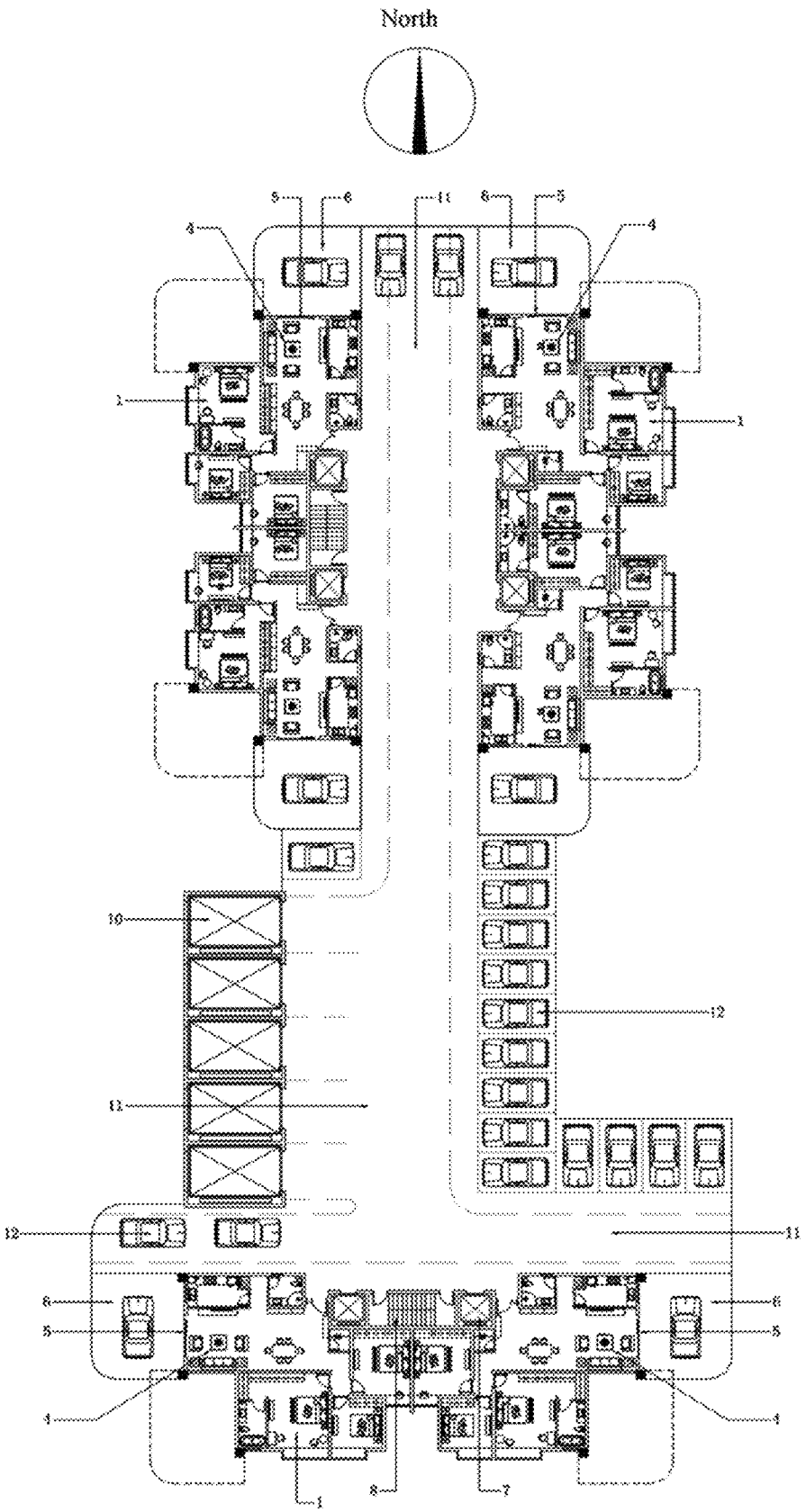
FIG. 10 is a schematic plan view of an odd-numbered floor in a house construction structure combined with a parking platform according to an embodiment of the present disclosure.
Figure 11:
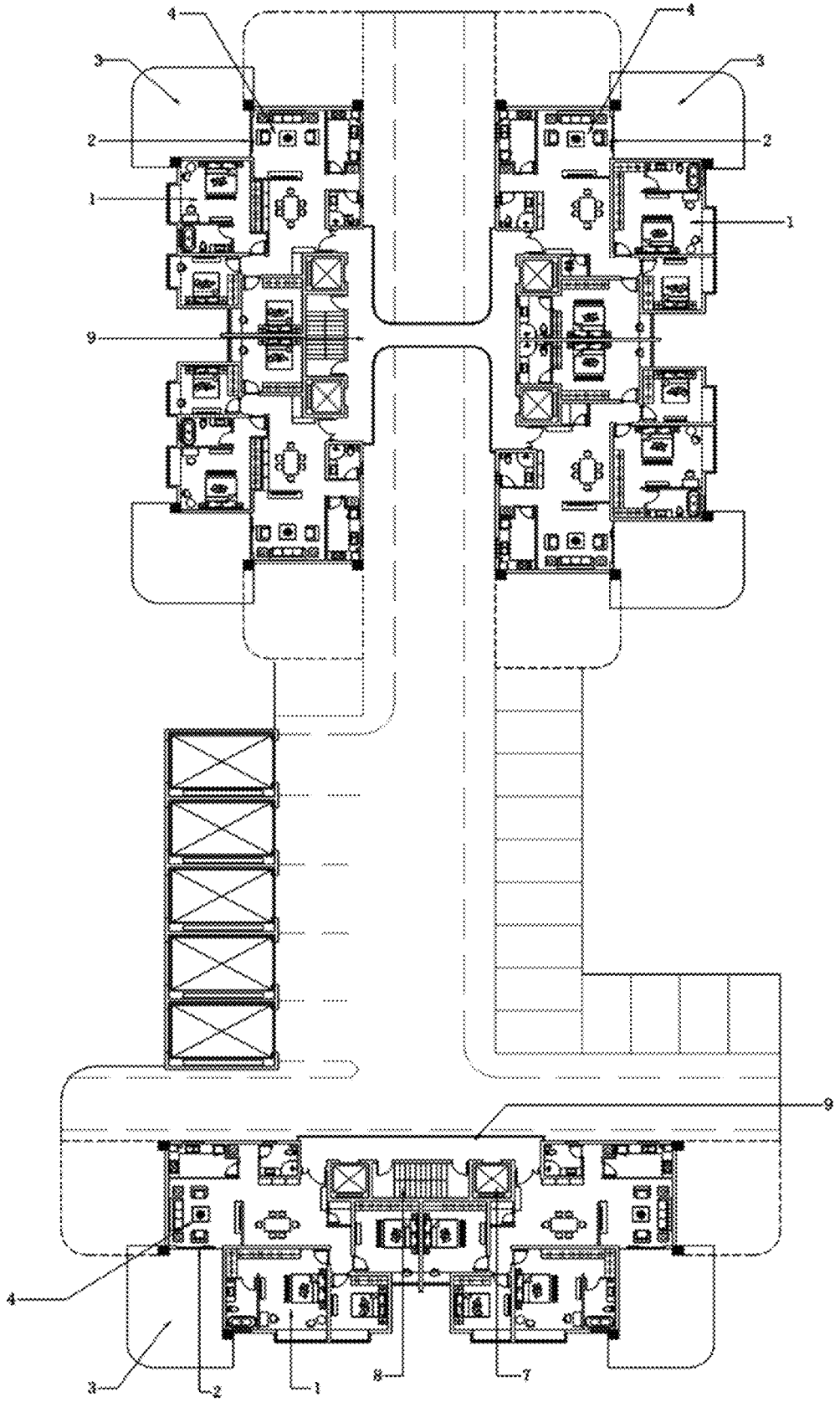
FIG. 11 is a schematic plan view of an even-numbered floor in a house construction structure combined with a parking platform according to an embodiment of the present disclosure.
Figure 12:
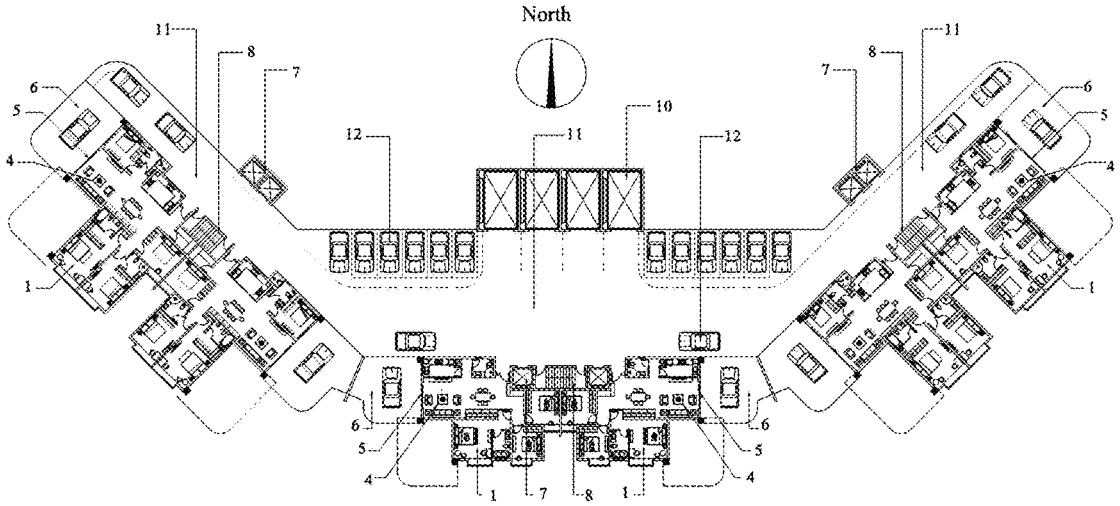
FIG. 12 is a schematic plan view of an odd-numbered floor in a house construction structure combined with a parking platform according to another embodiment of the present disclosure.
Figure 13:
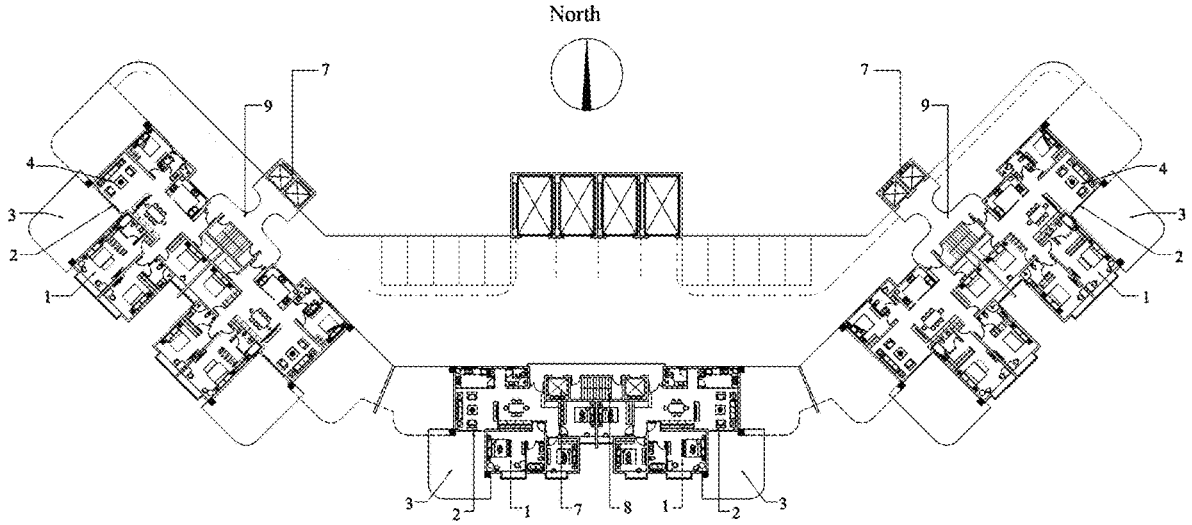
FIG. 13 is a schematic plan view of an even-numbered floor in a house construction structure combined with a parking platform according to another embodiment of the present disclosure.
Figure 14:
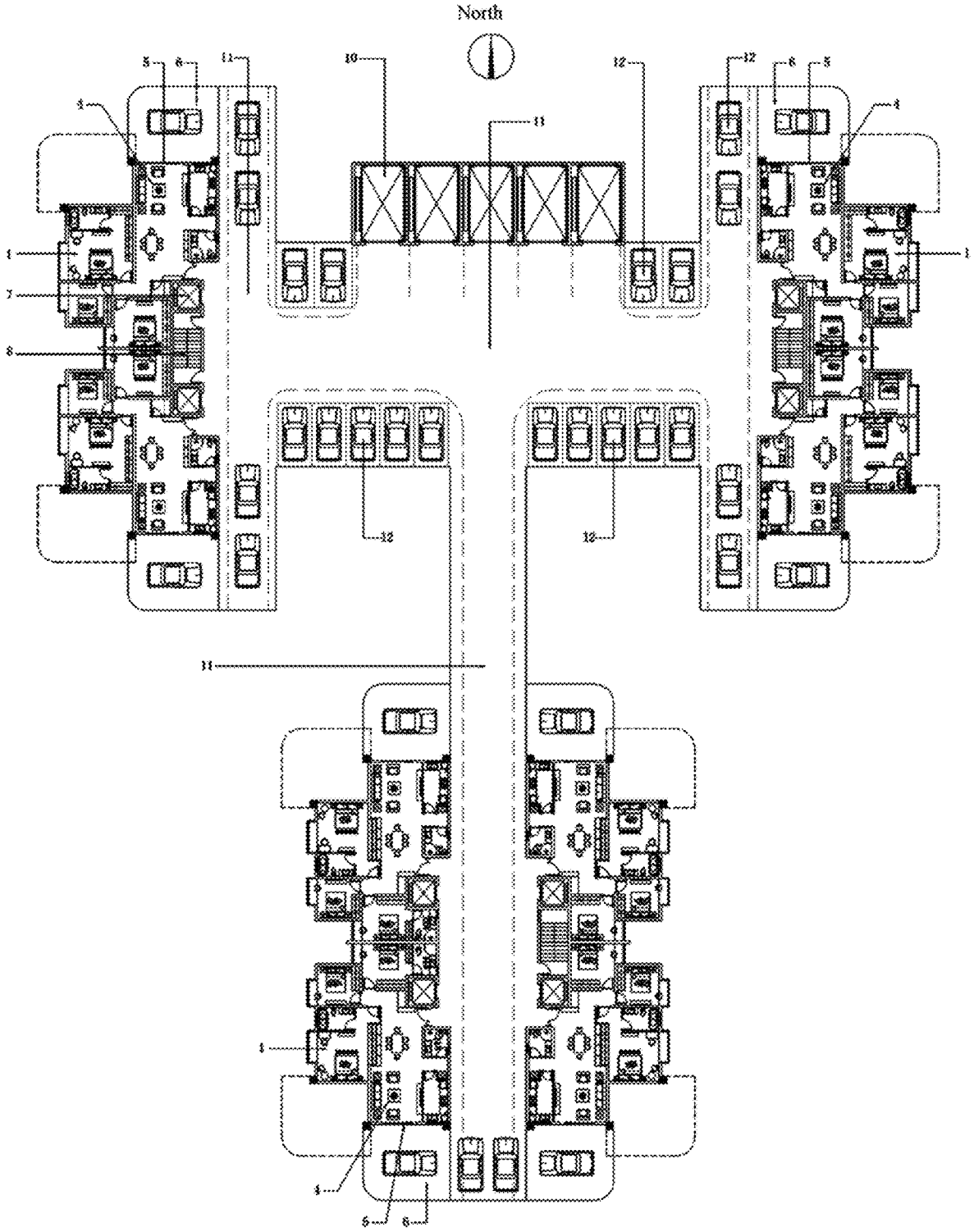
FIG. 14 is a schematic plan view of an odd-numbered floor in a house construction structure combined with a parking platform according to a third embodiment of the present disclosure.
Figure 15:
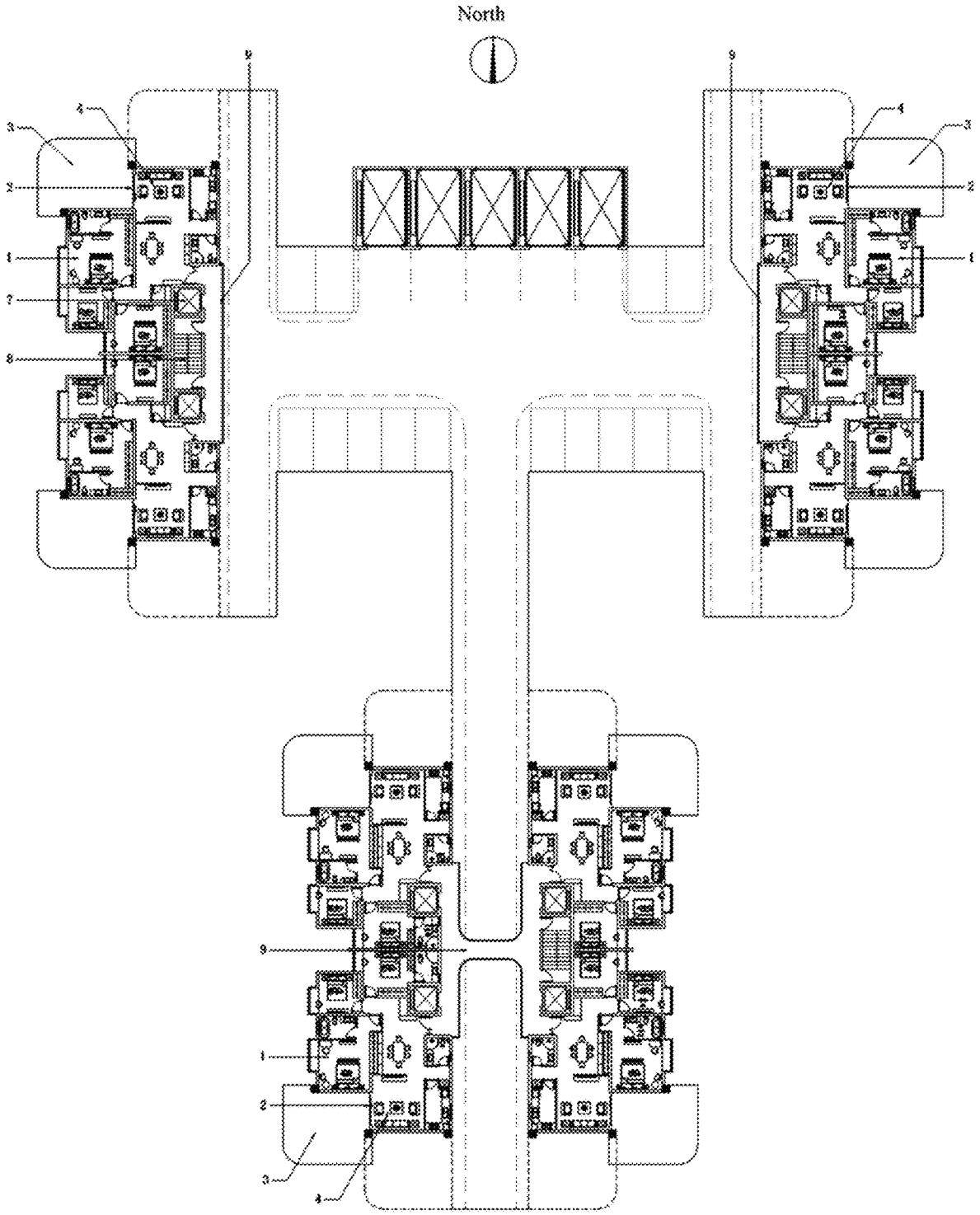
FIG. 15 is a schematic plan view of an even-numbered floor in a house construction structure combined with a parking platform according to a third embodiment of the present disclosure.
Figure 16:
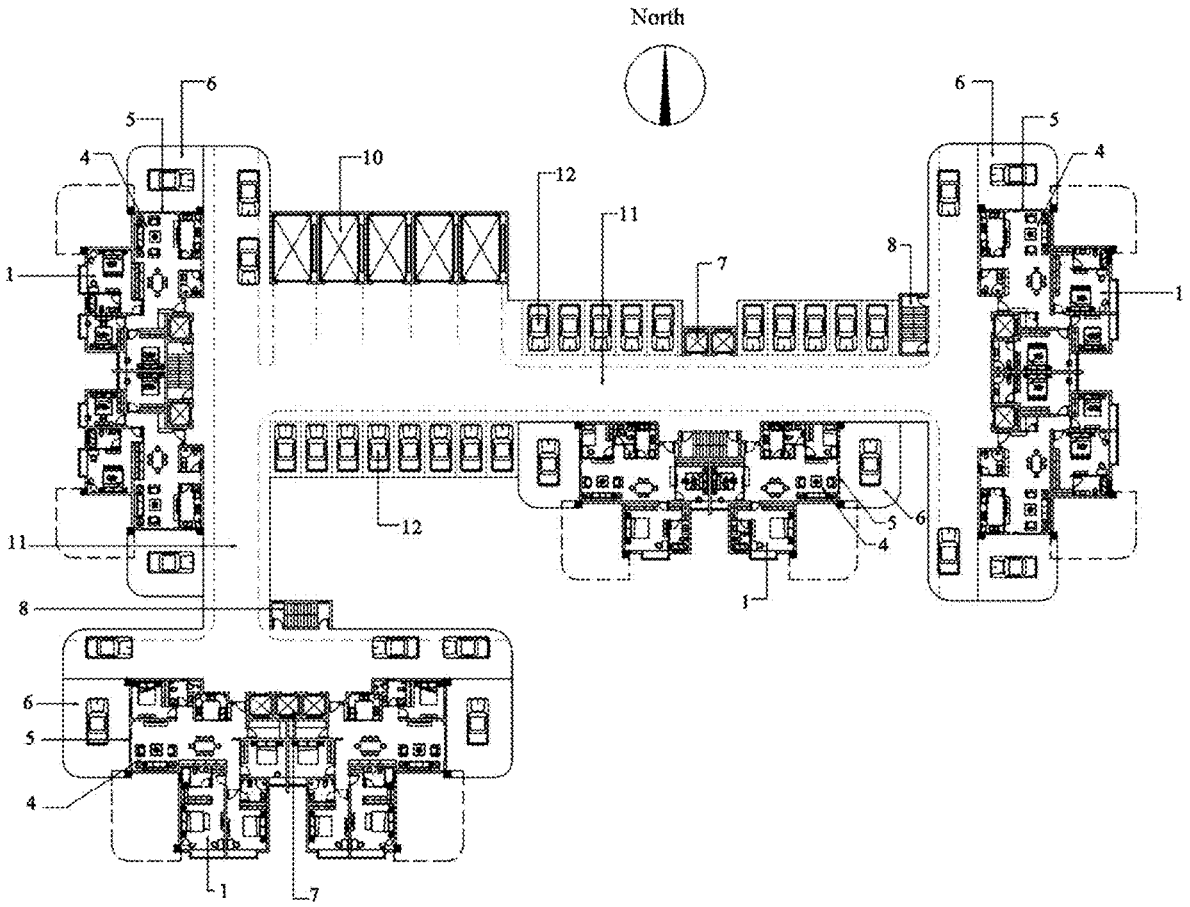
FIG. 16 is a schematic plan view of an odd-numbered floor in a house construction structure combined with a parking platform according to a fourth embodiment of the present disclosure.
Figure 17:
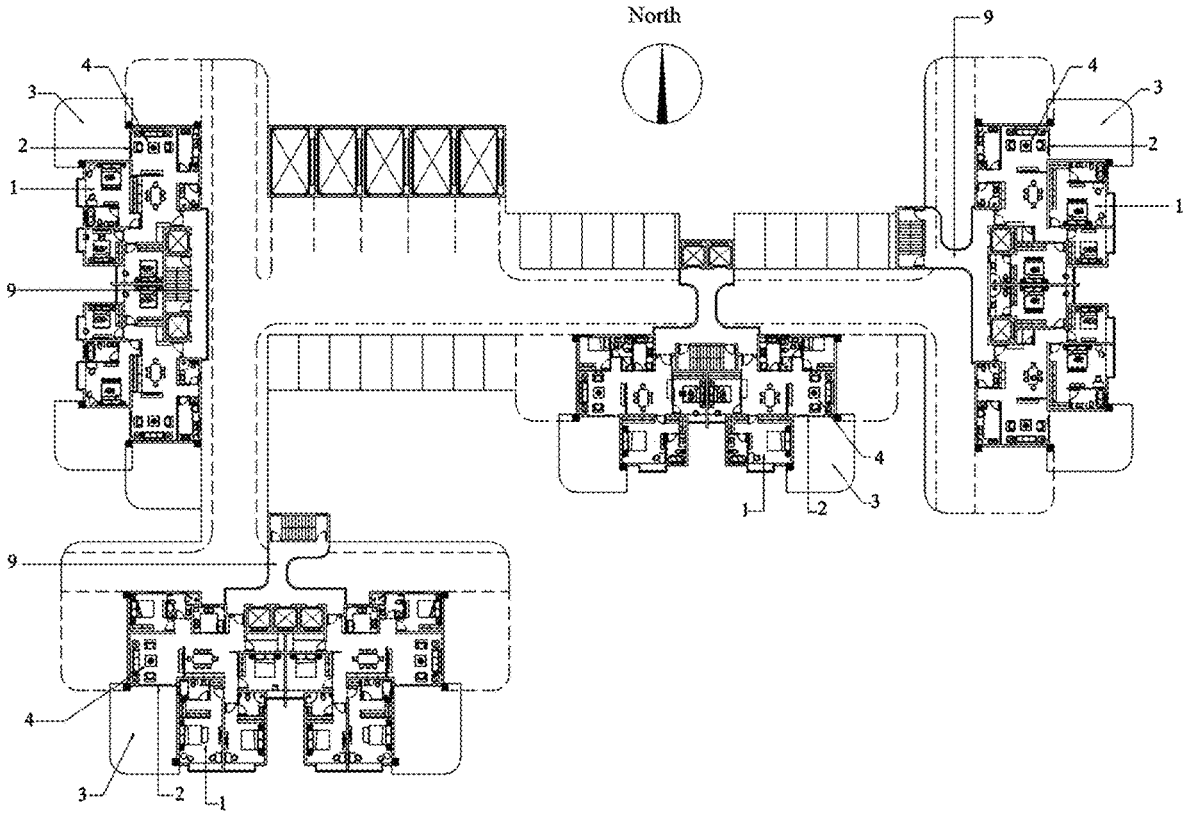
FIG. 17 is a schematic plan view of an even-numbered floor in a house construction structure combined with a parking platform according to a fourth embodiment of the present disclosure.

Referring to FIG. 8 and FIG. 9, a house construction unit with four houses on each floor is shown. In the drawings, an outer windowsill plate is arranged below a window of an auxiliary room, and the window of the auxiliary room is oriented towards the outdoor private garden of a low floor which is vertically corresponding to the auxiliary room; or, the window of the auxiliary room is changed to be formed in another outer wall of the auxiliary room, as shown in FIG. 2 and FIG. 3. It should be noted that the auxiliary room is generally a kitchen room, a bathroom, a maid's room, a dressing room, a storage room, and the like. In this embodiment, the type of the auxiliary room is not specifically distinguished, and the function of the auxiliary room is not specifically limited.

Referring to FIG. 10 to FIG. 19, the drawings show a car elevator 10, a driving road 11 and parking spaces 12, and such construction structure is a whole building which is composed of an above-ground parking platform combined with one unit house, two unit houses or multiple unit houses that are located on one side, two sides or a periphery of the above-ground parking platform. On each floor of the parking platform, a one-story house, a two-story house or a multi-story house may be formed, thereby forming a house construction structure with hanging parking platform.

Referring to FIG. 10 to FIG. 19, the parking platform is formed at the odd-numbered floor and includes a driving road 11, a car elevator 10 and parking spaces 12, and then parking and driving functions are concentrated on the odd-numbered floor. For example, a resident on an odd-numbered floor can transport a car through the car elevator 10 to the parking platform at the odd-numbered floor where the resident lives, drives the car along the driving road 11 to the parking space 12 near the resident's house to park, and then walks home.

When a resident on an even-numbered floor returns home, the resident on the even-numbered floor can transport a car through the car elevator 10 to an odd-floor parking platform below the house of the resident on the even-numbered floor. Then, the resident on the even-numbered floor drives the car along the driving road 11 to the resident's parking space 12. And then, the resident on the even-numbered floor may go home by taking the passenger elevator 7 or walking up the evacuation stair 8.

It should be noted that in the above drawings of the house construction structure with hanging parking platform, a two-story house is formed at each floor of the parking platform; however, in actual implementation process, on each floor of the parking platform, a one-story house, a two-story house or a multi-story house may be formed, which is not be limited by the embodiments described herein.

It should be noted that the above drawings of the house construction structure with hanging parking platform, may also indicate that the odd-floor outdoor private garden 6 may be used as a parking space. The even-floor outdoor private garden 3 is not connected with the parking platform and thus cannot be used as a parking space.

It should be noted that in the above drawings of the house construction structure with hanging parking platform, the above-ground parking platform further includes the evacuation stair 8 and the elevator-and-evacuation stair platform 9 in addition to the car elevator 10, the driving road 11 and the parking spaces 12.

In the above drawings of the house construction structure with hanging parking platform, the parking platform is generally set in the north of the house construction. The beneficial effect of such design is to orient the house construction in the directions of south, southwest and southeast, so that main rooms of all house constructions can have efficient lighting. Of course, it can be understood that the relative position relationship between the parking platform and the house construction is not limited in the embodiments of the present disclosure.

It should be noted that in the embodiments of the present disclosure, it is not limited to form unit houses on one side of the parking platform; alternatively, unit houses may be constructed on two sides or surroundings of the parking platform, and roads, street lanes and parking spaces may be provided in the parking platform.

It should also be noted that the embodiment of the disclosure does not limit the orientation of the building, and it is preferred that all the houses face south, and then southeast and southwest.

It should also be noted that the embodiment of the disclosure does not limit the number of houses, number of floors and types of houses to be built. Any implementer may make any increase or decrease in the number of houses and the number of floors in the house construction structure as shown in the drawings of the present disclosure, and may still make any modification to the house type as described in the present disclosure, or may also make the modification to the parking platform, the shape of the street lane, the position of the car elevator, the increase or decrease of the street lane, purposes of public areas, numbers and positions of the stairs and elevators, which are all deemed to be derived from the disclosure of the embodiments of the present disclosure.

Figure 20A:
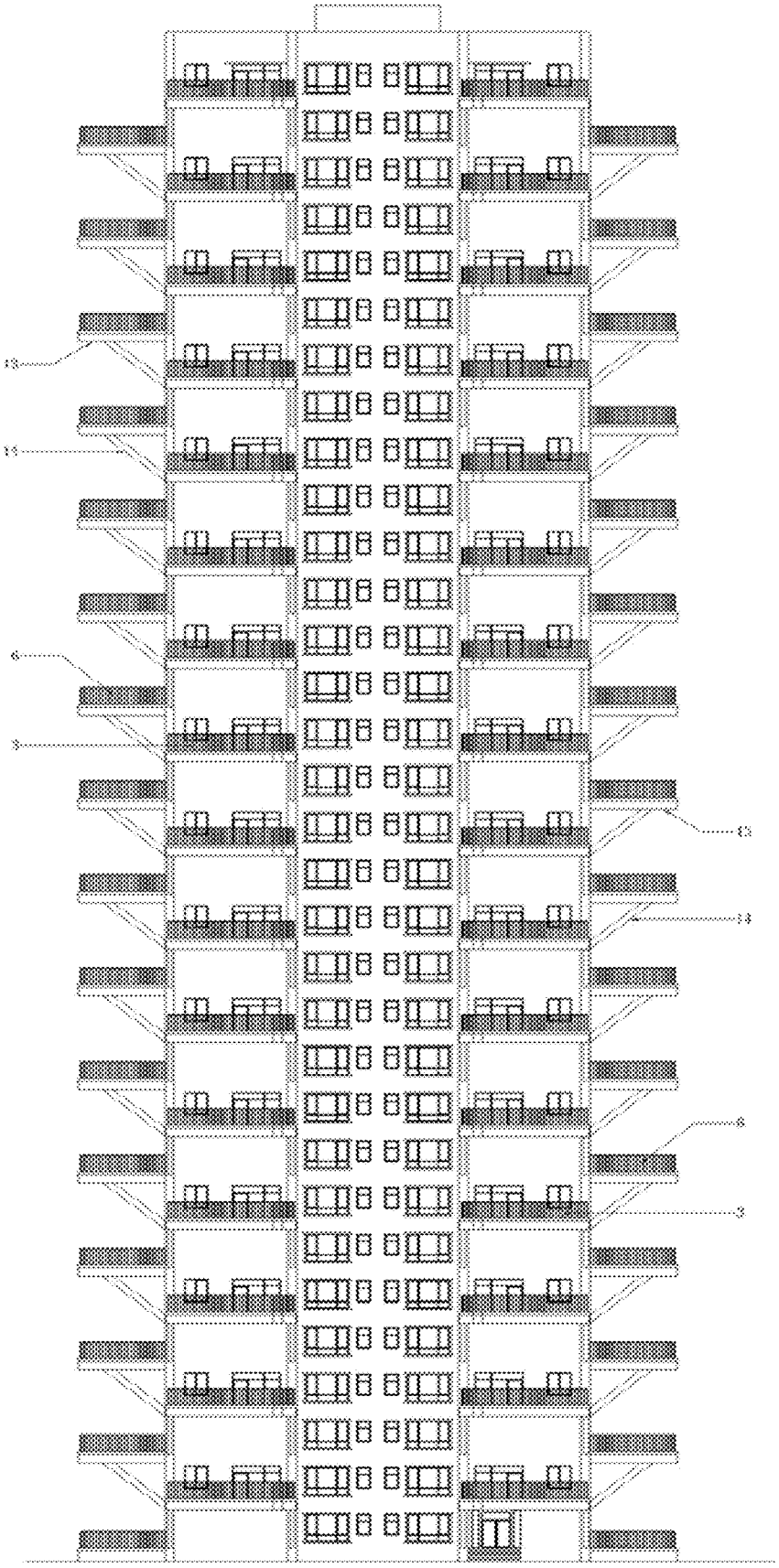
FIG. 20A is a schematic elevation view of architectural appearance of a house construction structure according to an embodiment of the present disclosure.

Referring to FIG. 20A, it is a schematic elevation view of architectural appearance of a house construction structure according to an embodiment of the present disclosure.

The elevation view can show directions and structures of the odd-floor houses, even-floor houses, windows and outdoor private gardens of the architectural design of the present disclosure from a side view angle.

The drawing shows the even-floor outdoor private garden 3, the odd-floor outdoor private garden 6, an outdoor private garden sinking board 13 and an oblique supporting column 14 for supporting the sinking board. It should be noted that specific structures of the outdoor private garden are not specifically limited in the embodiment of the present disclosure.

Figure 20B:
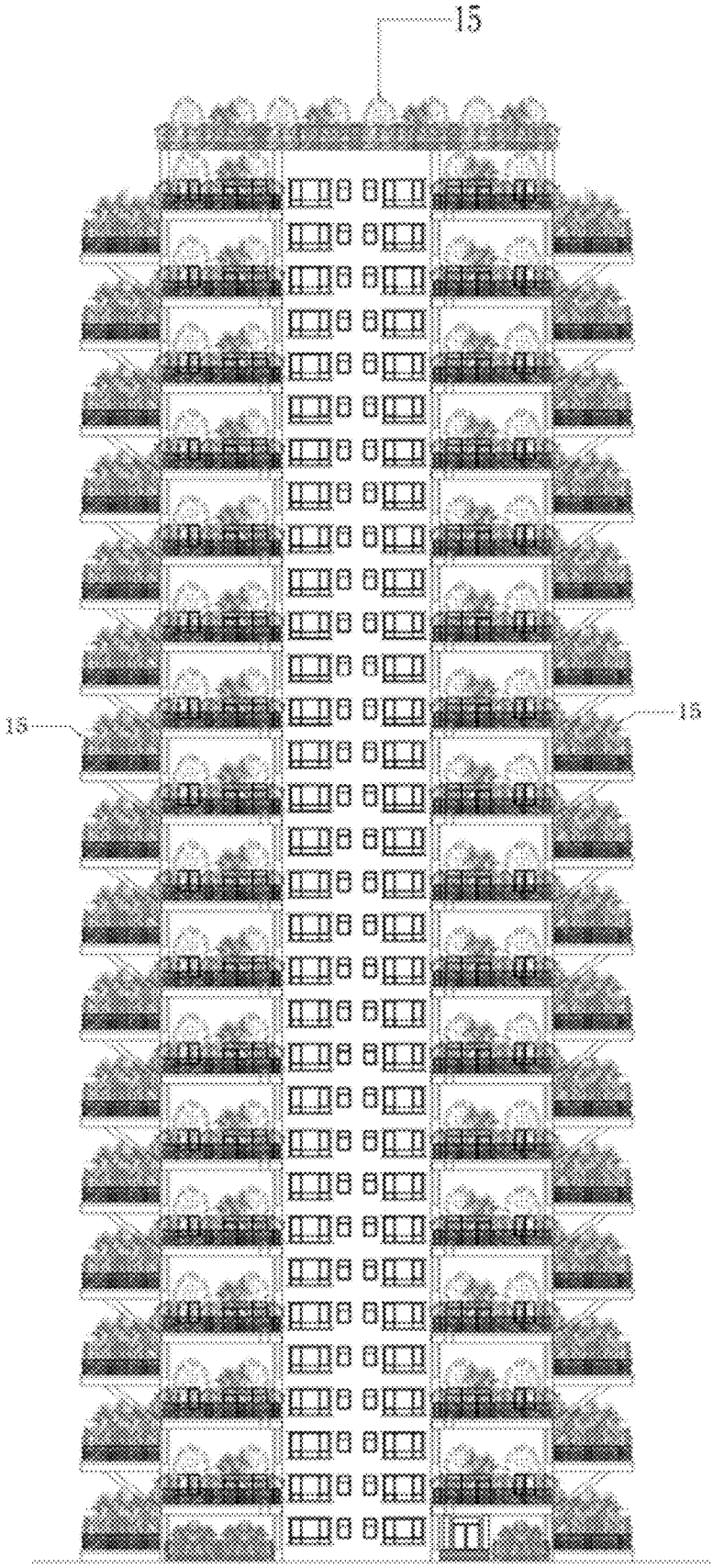
FIG. 20B is a schematic elevation view of architectural appearance of a house construction structure planted with trees for greening according to an embodiment of the present disclosure.
Figure 21A:
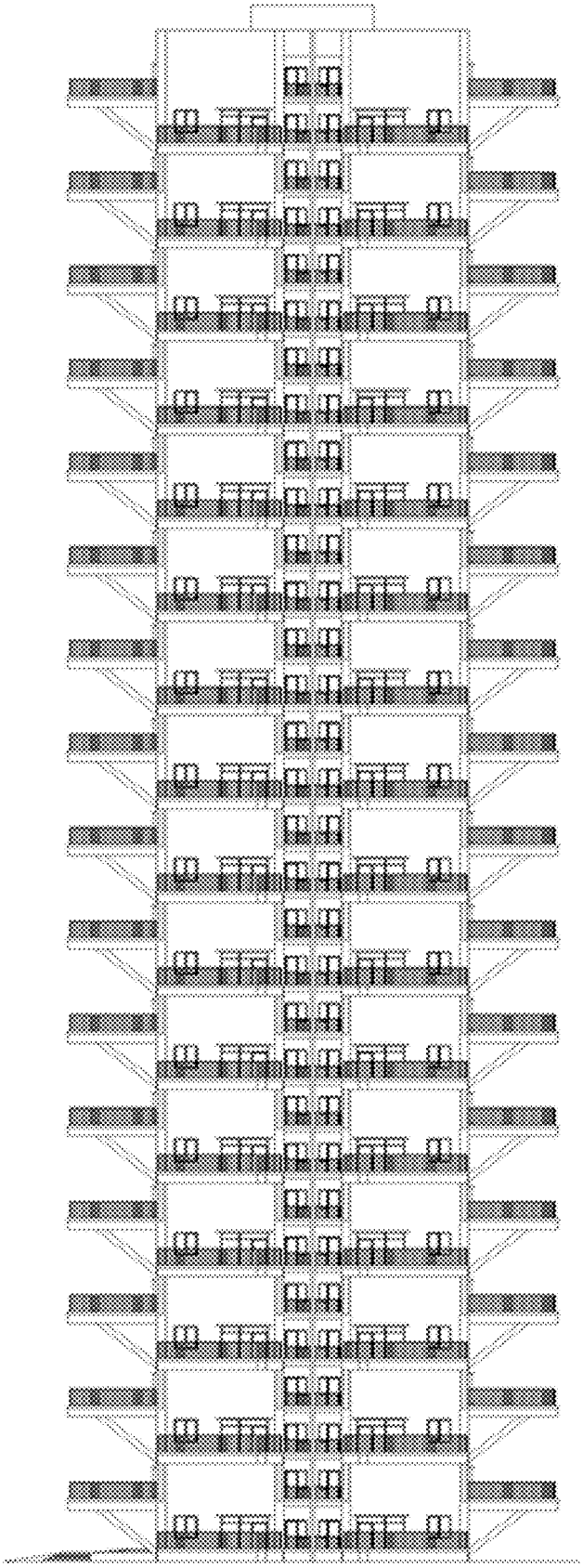
FIG. 21A is a schematic elevation view of architectural appearance of a house construction structure according to another embodiment of the present disclosure.
Figure 21B:
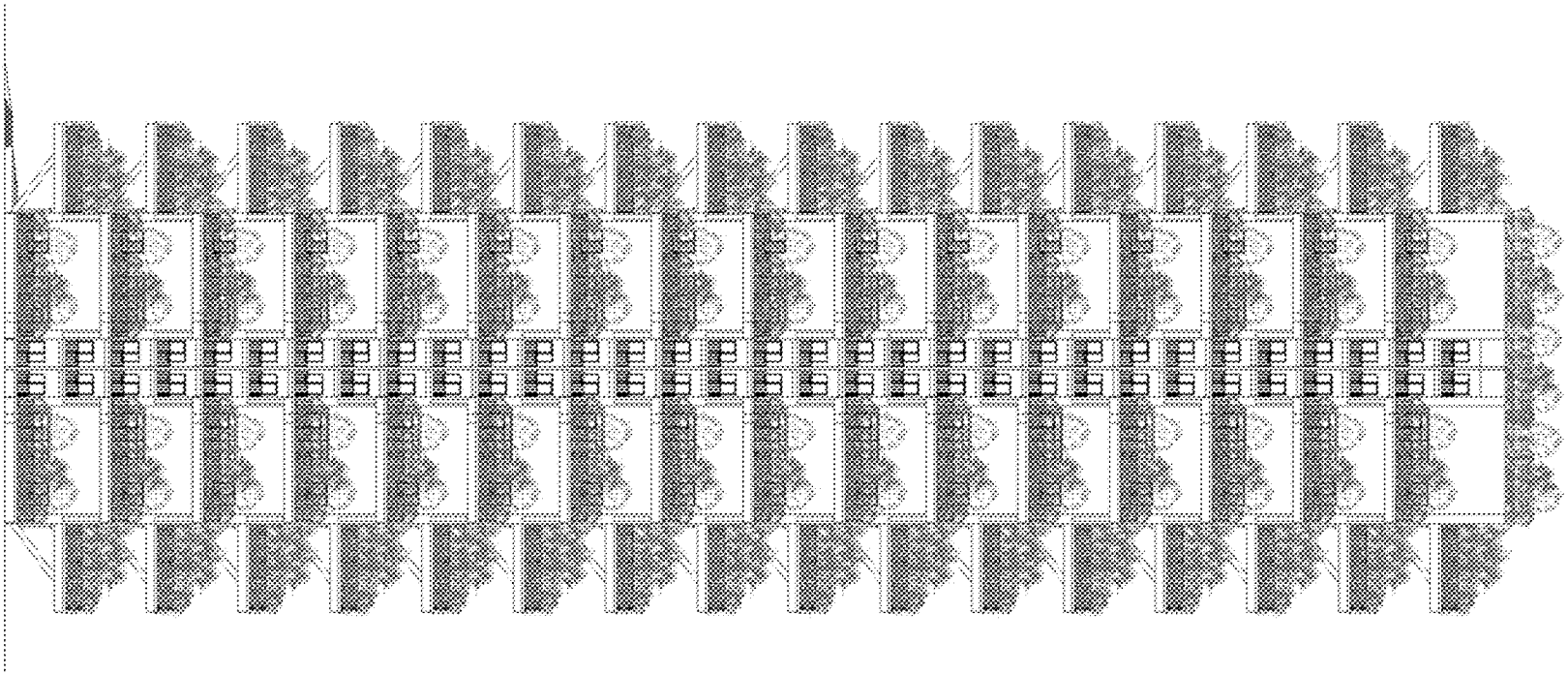
FIG. 21B is a schematic elevation view of architectural appearance of a house construction structure planted with trees for greening according to another embodiment of the present disclosure.

Referring to FIG. 20B, it is a schematic elevation view of architectural appearance of a house construction structure planted with trees for greening according to an embodiment of the present disclosure.

Figure 24A:
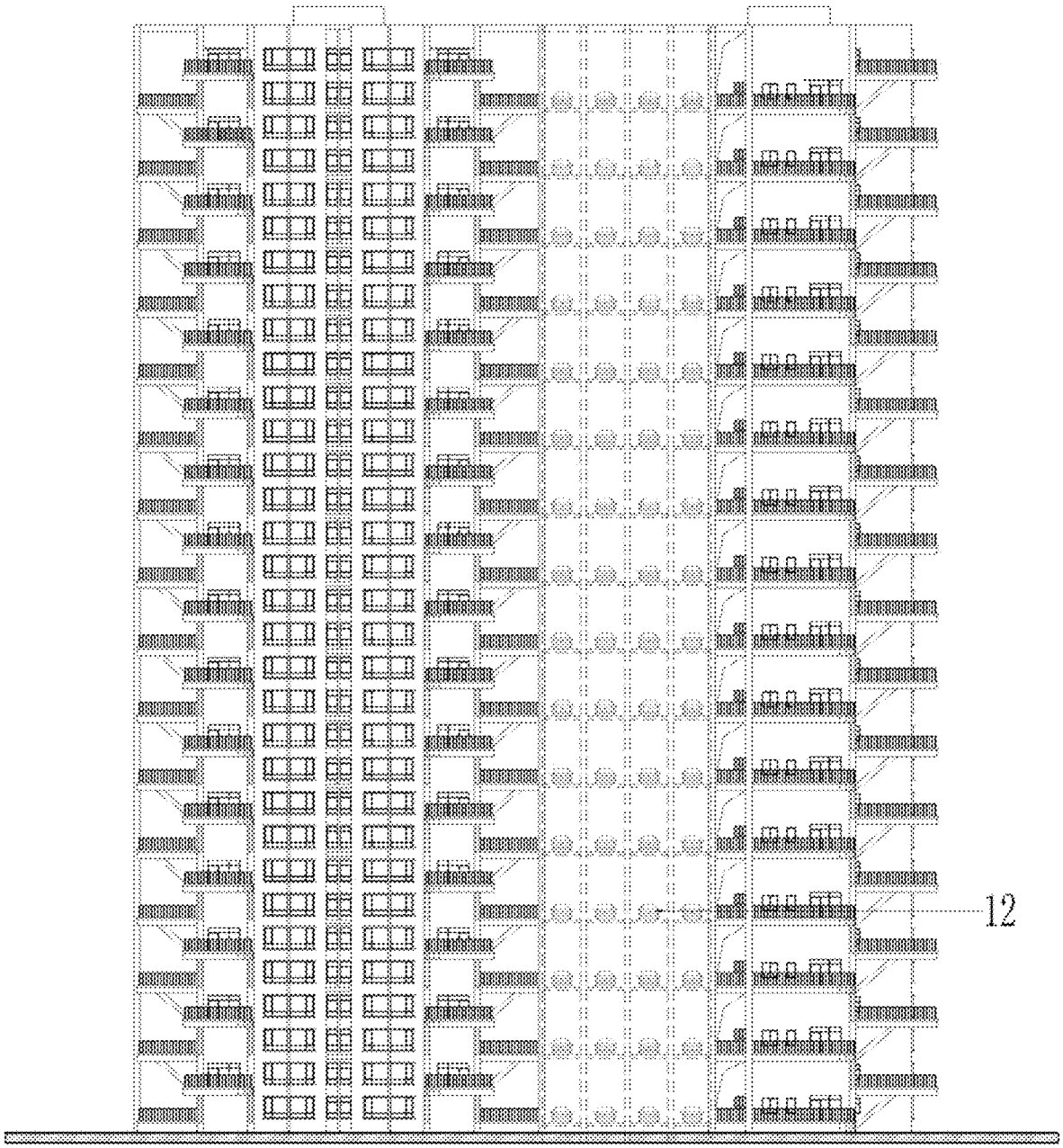
FIG. 24A is a schematic elevation view of architectural appearance of a house construction structure combined with a parking platform according to another embodiment of the present disclosure.
Figure 24B:
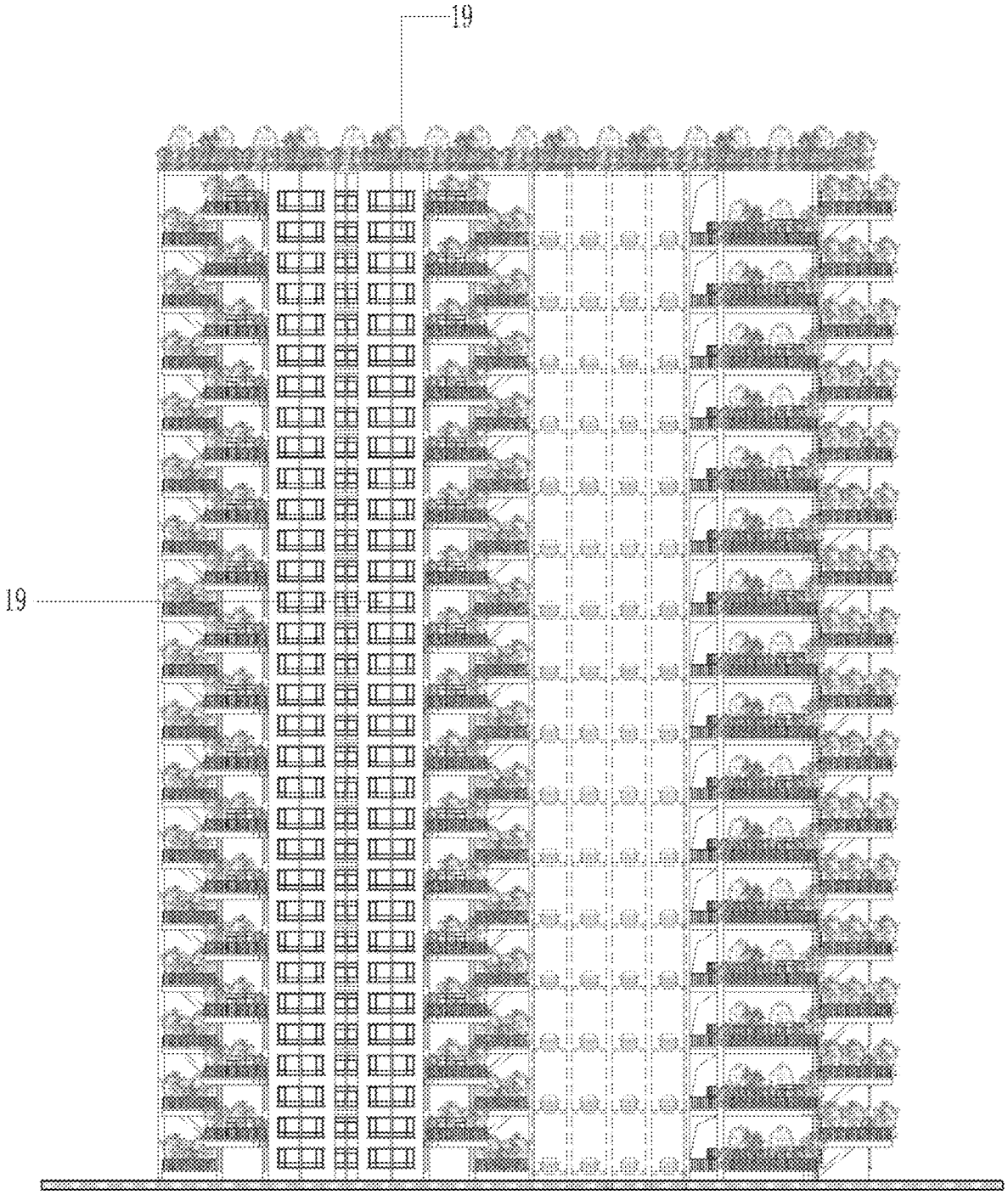
FIG. 24B is a schematic elevation view of architectural appearance of a house construction structure planted with trees for greening in combination with a parking platform according to another embodiment of the present disclosure.
Figure 25A:
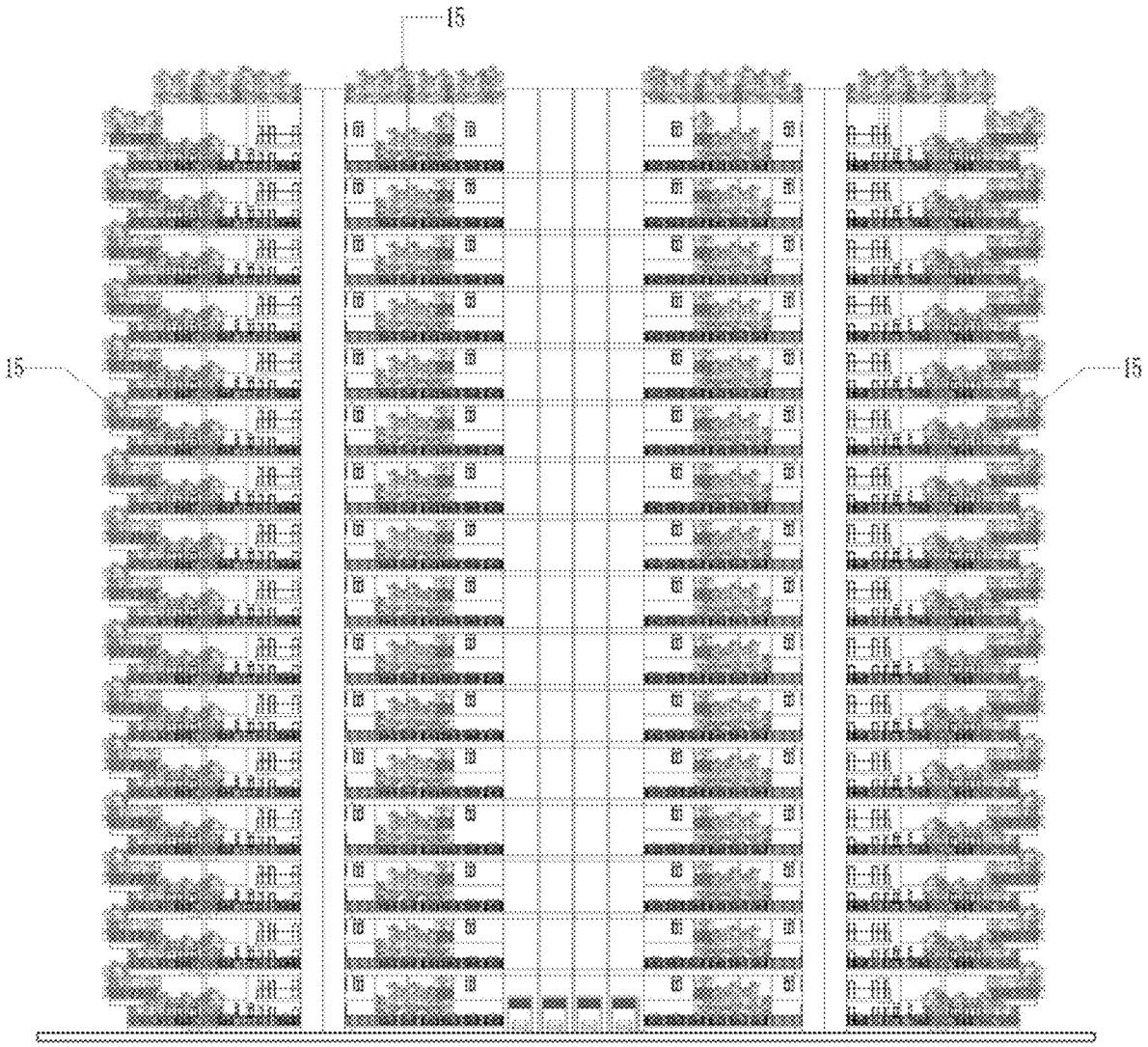
FIG. 25A is a schematic elevation view of architectural appearance of a house construction structure combined with a parking platform according to another embodiment of the present disclosure.
Figure 25B:
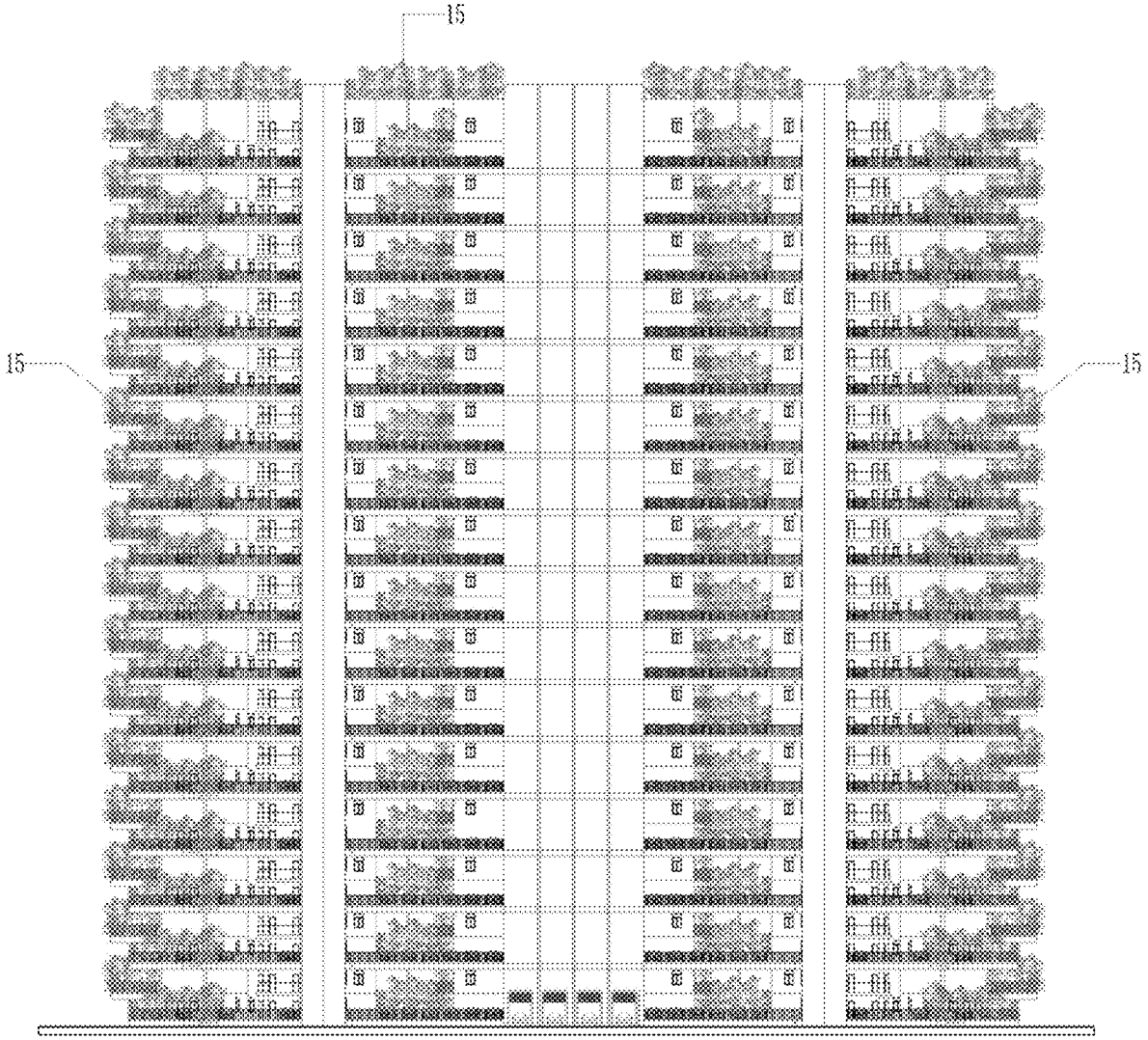
FIG. 25B is a schematic elevation view of architectural appearance of a house construction structure planted with trees for greening in combination with a parking platform according to another embodiment of the present disclosure.
Figure 26A:
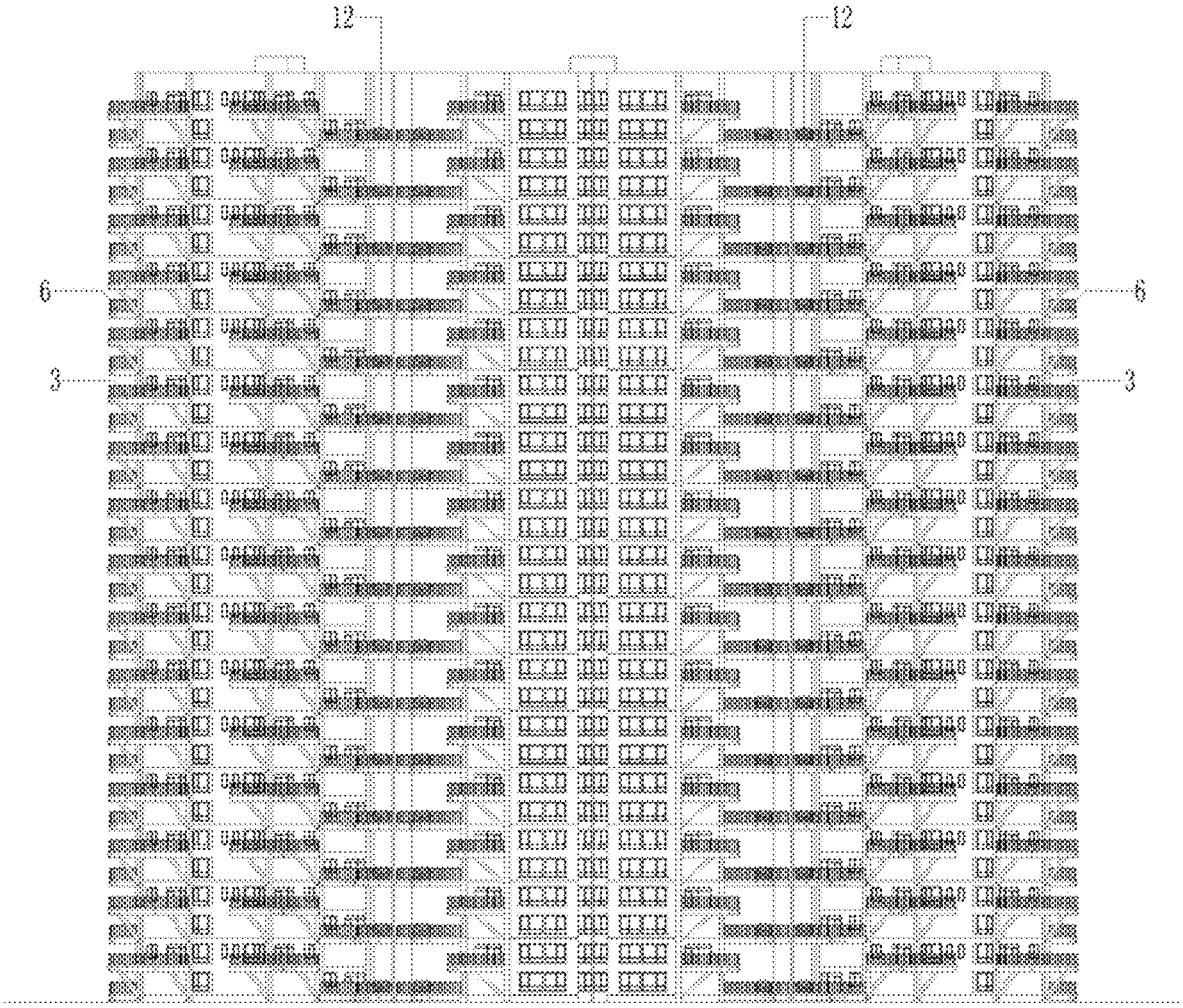
FIG. 26A is a schematic elevation view of architectural appearance of a house construction structure combined with a parking platform according to still another embodiment of the present disclosure.
Figure 26B:
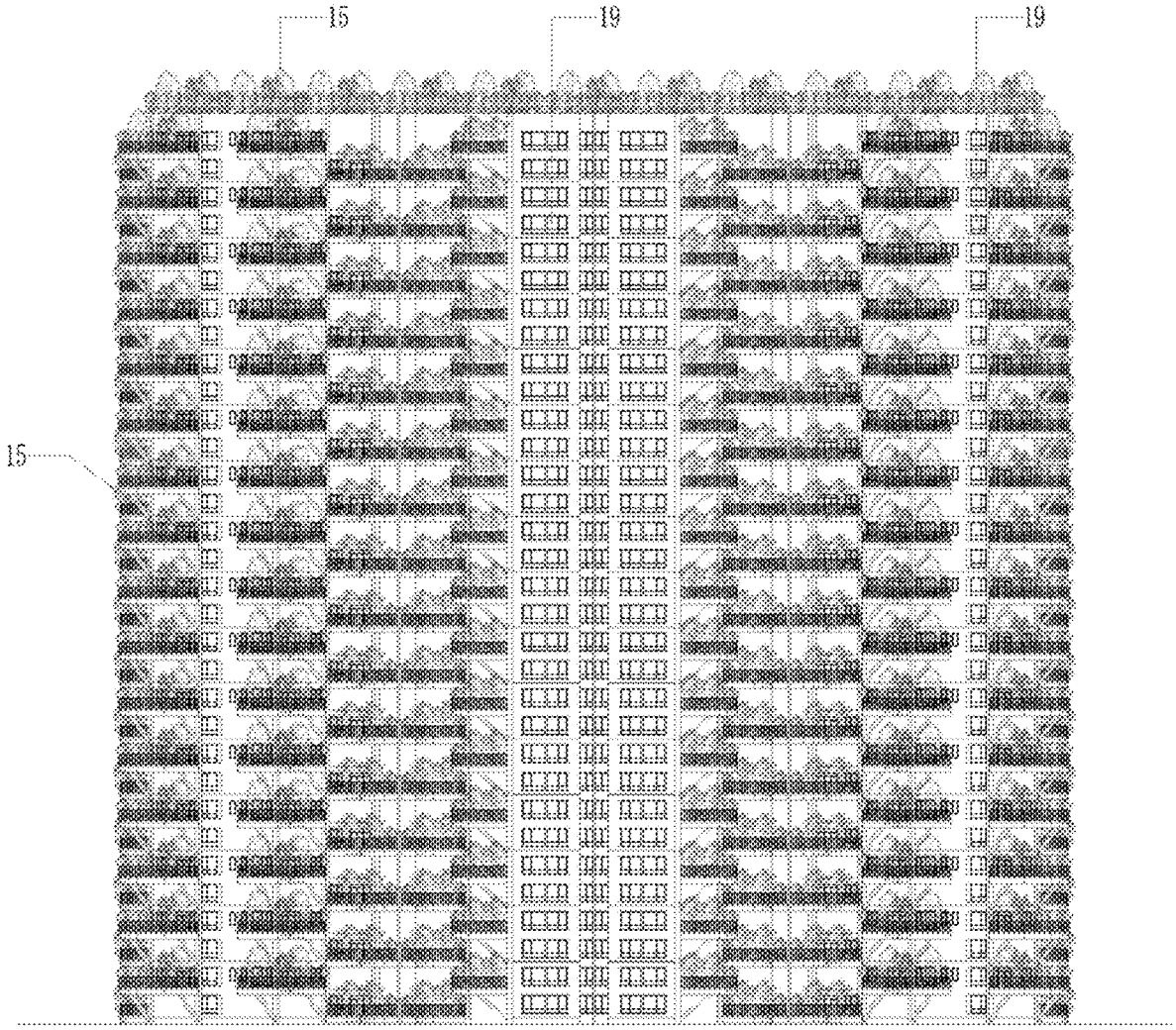
FIG. 26B is a schematic elevation view of architectural appearance of a house construction structure planted with trees for greening in combination with a parking platform according to still another embodiment of the present disclosure.

As shown in the drawing, after planting flowers and trees in all private gardens, the entire building is not completely covered, so that all windows of other rooms without private gardens are not blocked by flowers and trees and can be directly lighted, for example, the window 19 shown in FIG. 24B and FIG. 26B.

Figure 22:
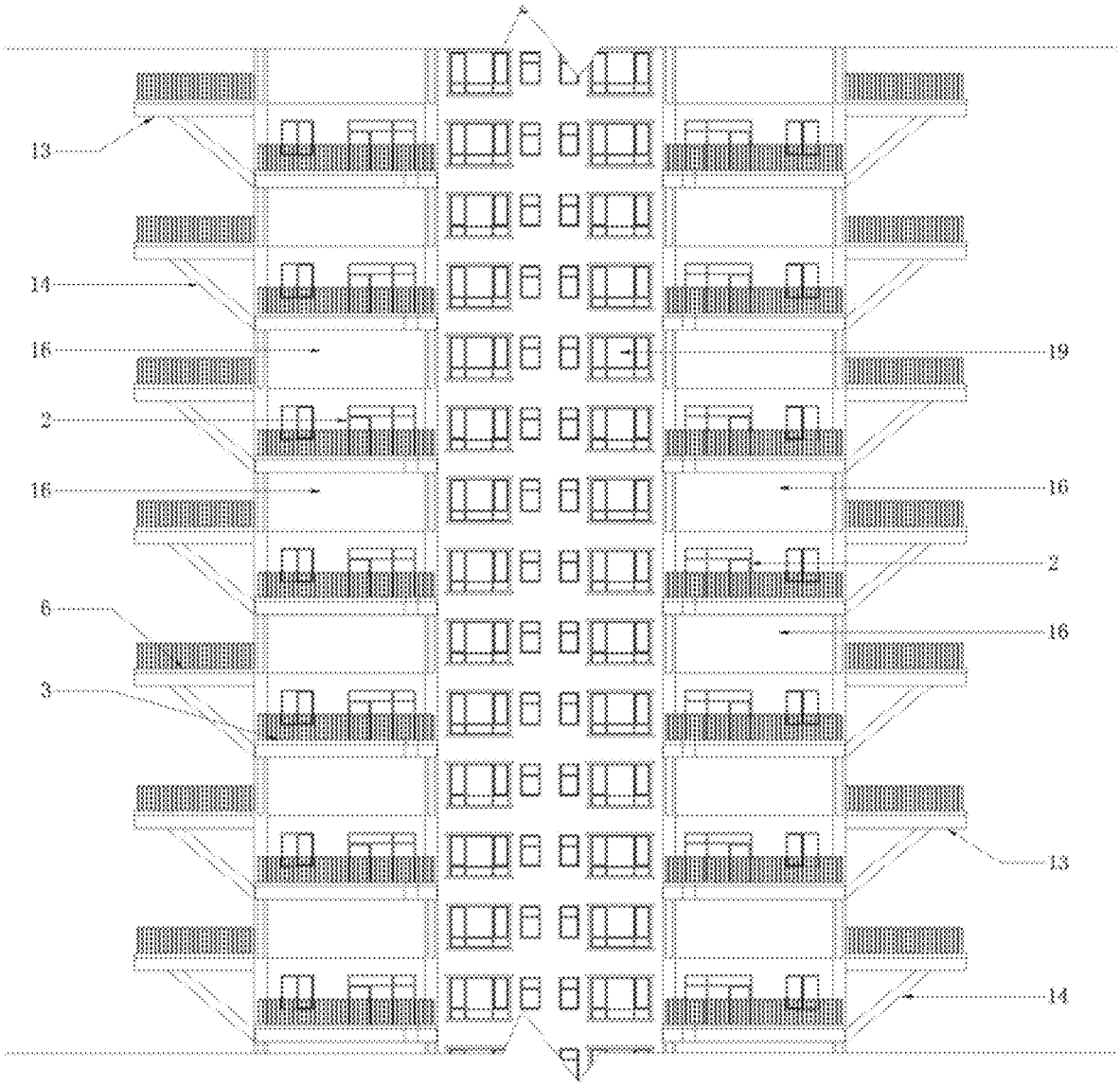
FIG. 22 is a partial schematic elevation view of a house construction structure according to another embodiment of the present disclosure.
Figure 23A:
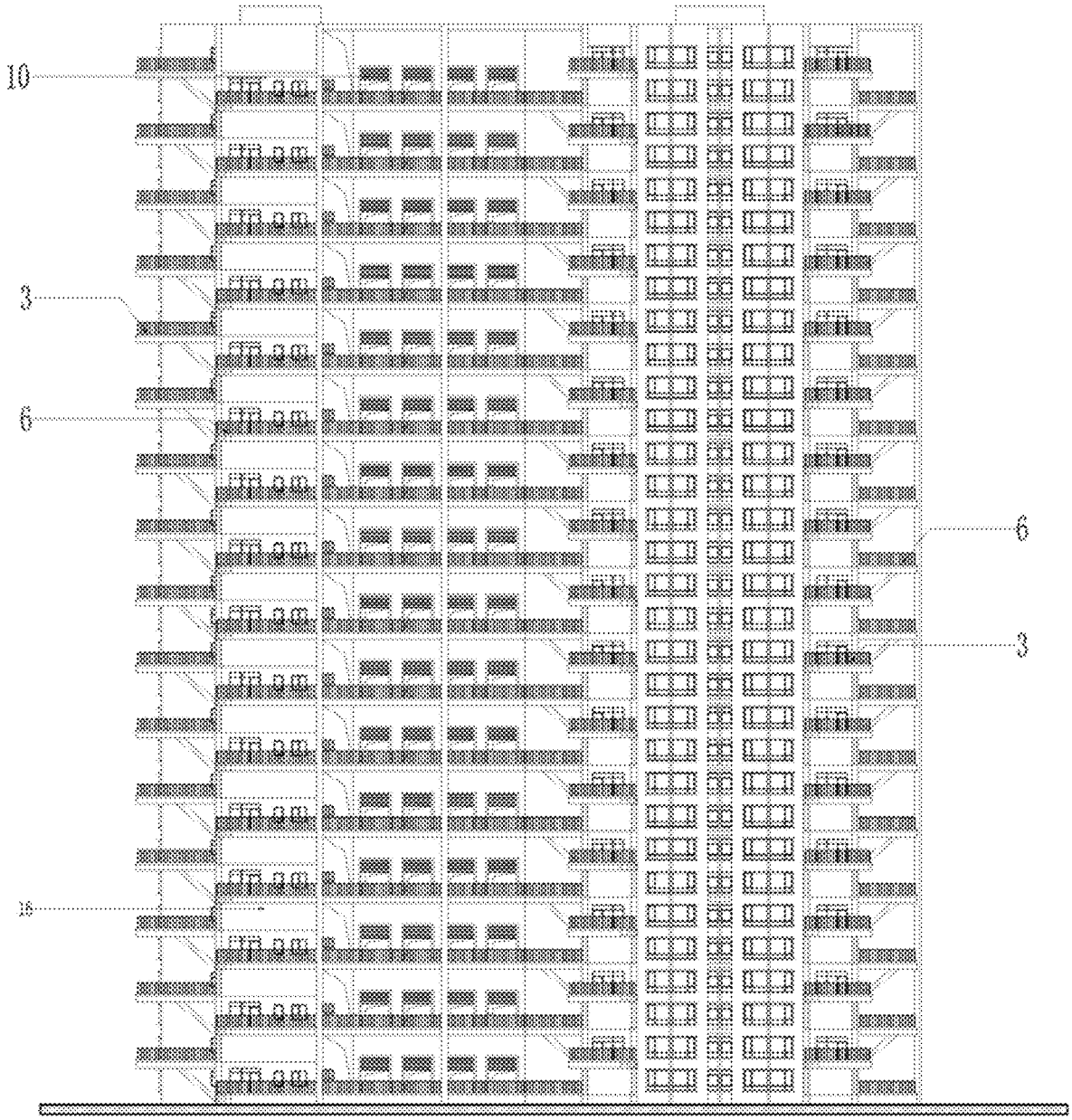
FIG. 23A is a schematic elevation view of architectural appearance of a house construction structure combined with a parking platform according to an embodiment of the present disclosure.
Figure 23B:
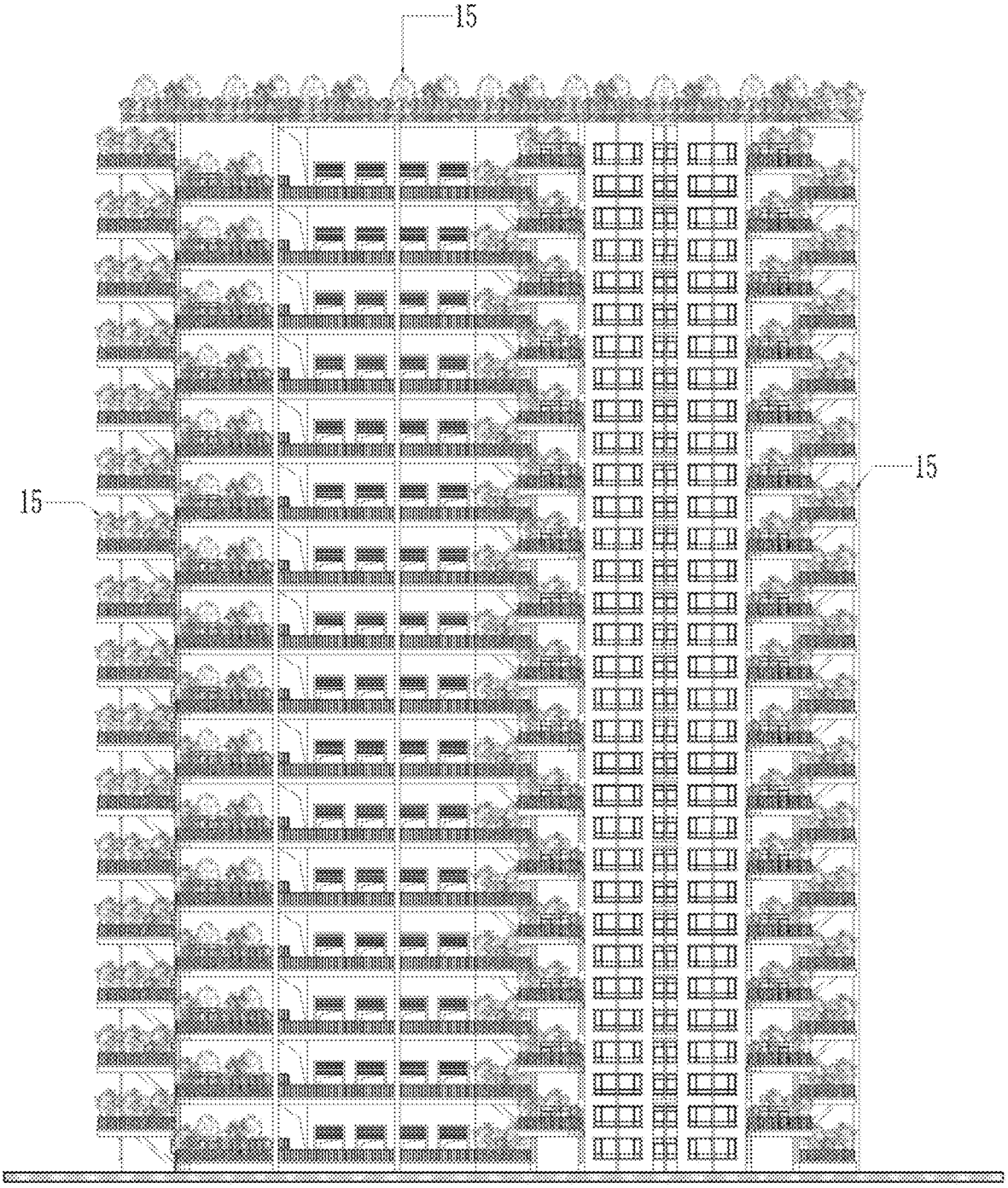
FIG. 23B is a schematic elevation view of architectural appearance of a house construction structure planted with trees for greening in combination with a parking platform according to an embodiment of the present disclosure.
Figure 27:
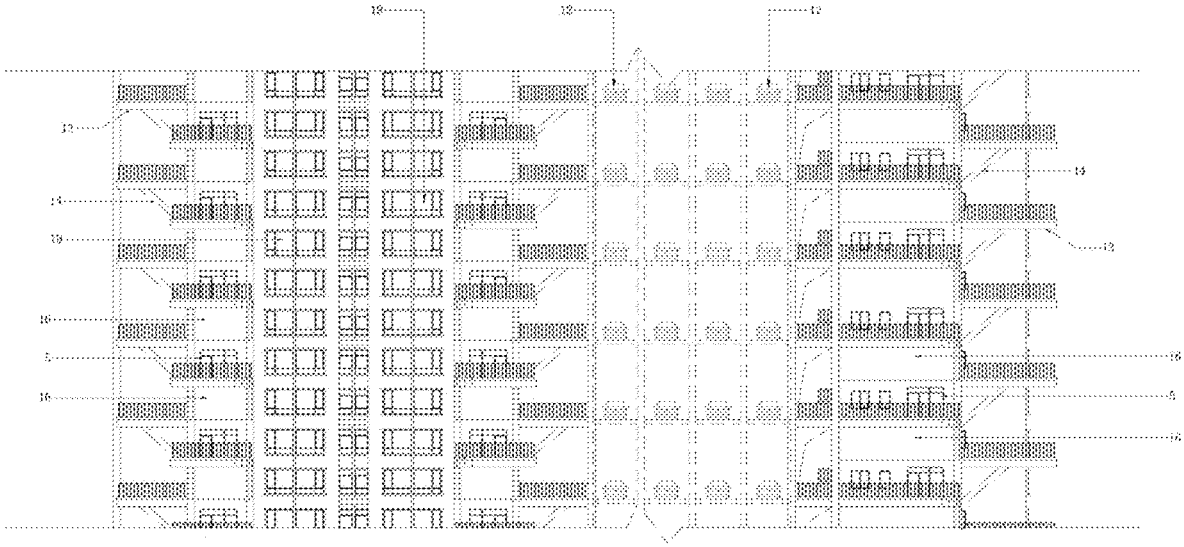
FIG. 27 is a partial schematic elevation view of a house construction structure in combination with a parking platform according to an embodiment of the present disclosure.

Referring to FIG. 22 and FIG. 27, which are partial schematic elevation views of a house construction structure according to an embodiment of the present disclosure, the house construction structure includes an even-floor outdoor private garden 3, an odd-floor outdoor private garden 6, an outdoor private garden sinking board 13, an oblique supporting column 14 and an outer wall 16 of upper layer vertically corresponding to outdoor private garden. No window is provided in the outer wall 16 of an upper layer vertically corresponding to each of the outdoor private garden 3 and the odd-floor outdoor private garden 6 of the living rooms 4 at a current odd-numbered floor or a current even-numbered floor, so that the outdoor private garden at a current floor has privacy.

Referring to FIG. 20A to and FIG. 27, a supporting structure of the outdoor private garden of the house construction structure includes: an outdoor private garden sinking board 13, an oblique supporting column 14 for supporting the outdoor private garden and protective railings.

For example, the structure of a reinforced concrete floor slab of the outdoor private garden is a sunken slab with an upturned beam and, which may optionally extends outward by 2 meters to 10 meters, for example, generally 6 meters.

The sunken slab is flush with a bottom of an outer cantilever beam. The main function of the outer cantilever beam and the sunken slab is to facilitate filling of soil in the outdoor private garden. Meanwhile, after filling the soil in the outdoor private garden, the outdoor private garden, the outdoor private garden is still lower than an indoor floor of the living room, and this facilitates residents to enter and exit the outdoor private garden. For example, there is a height difference of 0.1 meters to 1 meter between the bottom of the sunken slab and a top surface of the upturned beam, preferably about 0.6 meters, so as to fill the soil and plant flowers and trees.

For example, after leveling, the sunken slab has a waterproof slope in the direction towards an outer wall of the building, and a drain is provided near the wall with the lowest slope. After the sunken slab of the garden is leveled, a permanent waterproof layer is made. Optionally, in an upper layer of the waterproof layer, a waterproof layer-protective layer of 3 cm to 5 cm fine stone concrete is also be made, to prevent tree roots from passing through and destroying the waterproof layer.

In the embodiment of the present disclosure, the number of floors of the building structure is cyclically arranged according to the required height of the building, and apartment layouts may be one house on each floor, two houses on each floor, three houses on each floor, four houses on each floor, five houses on each floor, six houses on each floor. The size or area of apartment layout of each floor may still be arbitrarily modified or changed according to needs. It should be noted that the number of floors and apartment layouts are not limited in the embodiments of the present disclosure.

Optionally, the green area of the outdoor private garden is in a range of from 10 square meters to 200 square meters, and protective railings are provided at an outer edge of the garden. The protective railings in the outdoor private garden are used to protect persons and objects in the outdoor private garden from falling down.

Optionally, the house construction structure further includes an automatic drip irrigation-sprinkler irrigation system in the outdoor private garden. All flowers and trees in the garden may be watered by using automatic drip irrigation-sprinkler irrigation technology to reduce the maintenance cost and achieve automatic maintenance when no one is at home.

Optionally, the purpose of the above building structure is any one of residence, apartment, guesthouse, hotel, restaurant, office premises and office building.

The above are merely the preferred embodiments of the present disclosure. It should be noted that, a person skilled in the art may make improvements and modifications without departing from the principle of the present disclosure, and these improvements and modifications shall also fall within the scope of the present disclosure.

What is claimed is:

1. A house construction structure comprising: an odd-numbered floor, an even-numbered floor and outdoor private gardens;

wherein each of the odd-numbered floor and the even-numbered floor includes one unit house, two unit houses or multi-unit houses; each unit house includes one house, two houses or multiple houses;

wherein living rooms of each odd-floor house and each even-floor house which are vertically corresponding to each other, are vertically corresponding to each other; each living room is provided with one outdoor private garden;

wherein the outdoor private gardens of all living rooms of odd-floor houses which are vertically corresponding to each other, are vertically corresponding to each other and are located in an identical first direction; the outdoor private gardens of all living rooms of even-houses which are vertically corresponding to the odd-floor houses, are vertically corresponding to each other and are located in an identical second direction, thereby allowing all private gardens to have a height of two floors and allowing direct lighting of the living room on a lower floor in two floors corresponding to one private garden;

each living room of each house is located at an outer wall corner of each house; each living room of each house includes at least one outer wall corner and at least two adjacent outer walls in different directions;

private gardens of each odd-floor house and each even-floor house which are vertically corresponding to each other, are disposed on the two adjacent outer walls of the respective living rooms of each odd-floor house and each even-floor house which are vertically corresponding to each other, and located in two different directions, thereby allowing each outdoor private garden to have at least two lighting surfaces in two directions and a large space;

for each wall having a window of each room of each of odd-floor houses and the even-floor houses, no private garden is provided on a vertically corresponding wall of a room on an upper floor and a vertically corresponding wall on a lower floor, thereby allowing direct lighting of each room having a window and enabling windows of all rooms on the upper floor do not directly face the private garden on the lower floor;

wherein at least one unit house is located on at least one side or a periphery of an above-ground parking platform, and is combined with the above-ground parking platform to form a whole building;

wherein on each floor of the parking platform, a two-story house or a multi-story house is formed; and at least one of the outdoor private gardens of the two-story house or the multi-story house formed on each floor of the parking platform, is connected with the parking platform and used as a parking space.

2. The house construction structure according to claim 1, wherein the parking platform is composed of a car elevator, a fire evacuation stair, a passenger elevator, a driving road and parking spaces; the number of floors of the parking platform is in a range of 2 to 30.

3. The house construction structure according to claim 1, wherein the number of floors of the odd-numbered floor and the even-numbered floor is cyclically arranged according to a required height of the house construction structure; the outdoor private gardens are set according to the number of houses on each floor.

4. The house construction structure according to claim 1, wherein for one room having a window, the private garden is provided on an outer wall of a lower-floor room which is vertically corresponding to the one room; the window of the one room and the private garden of the lower-floor room are in different directions, or an outer windowsill plate is arranged below the window of the one room, thereby blocking downward view and improving privacy of the private garden of lower-floor room.

5. The house construction structure according to claim 1, wherein for the two adjacent outer walls in different directions of each living room of each house, a width of the living room corresponding to each outer wall is 2 meters to 10 meters.

6. The house construction structure according to claim 1, wherein for one living room provided with the private garden, no window is formed in an outer wall of an upper-floor living room, and the outer wall of the upper-floor living room is vertically corresponding to the private garden of the one living room.

7. The house construction structure according to claim 1, wherein a door-and-window is formed in one outer wall of each the living room, and the private garden of the each the living room is formed on the one outer wall.

8. The house construction structure according to claim 1, wherein each of outdoor private gardens for the odd-numbered floor and the even-numbered floor is supported by an oblique supporting column and has a sunken slab with an upturned beam and a sunken portion for filling soil, thereby planting vegetables or flowers and trees in the sunken portion.

9. The house construction structure according to claim 1, wherein the house and the outdoor private garden adopt a concrete structure, a steel structure or a steel-concrete structure.

10. The house construction structure according to claim 1, wherein the outdoor private garden is provided with an automatic drip irrigation system or an automatic sprinkler irrigation system, a drainage system, and a waterproof layer under soil.

11. The house construction structure according to claim 1, wherein the house construction structure is any one of residence, apartment, guesthouse, hotel, restaurant, office premises and office building.

12. The house construction structure according to claim 1, wherein the above-ground parking platform includes driving roads and pedestrian passages.

13. The house construction structure according to claim 1, wherein an edge of the above-ground parking platform is provided with reinforced concrete railings poured along with the parking platform.

14. The house construction structure according to claim 1, wherein the at least one of the outdoor private gardens of the two-story house or the multi-story house is located between two adjacent floors of the parking platform.

* * * * *